US007068243B2

(12) United States Patent
Morimoto

(10) Patent No.: US 7,068,243 B2
(45) Date of Patent: Jun. 27, 2006

(54) PLASMA DISPLAY DEVICE AND DRIVING METHOD THEREOF

(75) Inventor: Takashi Morimoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 261 days.

(21) Appl. No.: 10/270,571

(22) Filed: Oct. 16, 2002

(65) Prior Publication Data

US 2003/0080926 A1 May 1, 2003

(30) Foreign Application Priority Data

Oct. 30, 2001 (JP) ..... 2001-331745

(51) Int. Cl.
*G09G 3/28* (2006.01)

(52) U.S. Cl. ..... 345/60; 345/67; 315/169.4

(58) Field of Classification Search ..... 345/60–68, 345/690–698, 88, 89, 43, 596–599
See application file for complete search history.

(56) References Cited

U.S. PATENT DOCUMENTS 4,827,255 A * 5/1989 Ishii ..... 345/692
5,126,865 A * 6/1992 Sarma ..... 349/85
5,404,236 A * 4/1995 Hartmann et al. ..... 349/143
5,499,037 A * 3/1996 Nakagawa et al. ..... 345/89
5,719,651 A * 2/1998 Okada et al. ..... 349/85
5,748,163 A * 5/1998 Han ..... 345/88
5,903,253 A * 5/1999 Mizutome et al. ..... 345/694
6,088,011 A * 7/2000 Lee et al. ..... 345/60
6,097,357 A 8/2000 Shinoda et al.
6,097,358 A * 8/2000 Hirakawa et al. ..... 345/63
6,714,206 B1 * 3/2004 Martin et al. ..... 345/589
2002/0030644 A1 3/2002 Ishii et al.

FOREIGN PATENT DOCUMENTS

| | | |
|---|---|---|
| JP | 48-51581 | 7/1973 |
| JP | 53-33012 | 9/1978 |
| JP | 55-046783 | 4/1980 |
| JP | 05-266800 | 10/1993 |
| JP | 9-6283 A | 1/1997 |
| JP | 09-160525 | 6/1997 |
| JP | 10-187089 | 7/1998 |
| JP | 11-133912 A | 5/1999 |
| JP | 11-329252 | 11/1999 |
| JP | 2000-66637 A | 3/2000 |
| JP | 2000-100333 | 4/2000 |
| JP | 2001-015039 | 1/2001 |
| JP | 2001-215922 | 8/2001 |

OTHER PUBLICATIONS

Taiwanese Office Action mailed Dec. 17, 2003 in corresponding Taiwanese application No. 2001-331745.

* cited by examiner

*Primary Examiner*—Xiao Wu
(74) *Attorney, Agent, or Firm*—Nixon & Vanderhye P.C.

(57) ABSTRACT

The plasma display device has pixels each formed by a plurality of sub pixels of the same color provided in an address-electrode direction, and provides gray-scale display by controlling the number of sub pixels to be turned ON. A plurality of address electrodes are provided for each sub pixels. Each sub pixel is addressed by a conductive layer which is electrically connected to one of the plurality of address electrodes.

6 Claims, 17 Drawing Sheets

PLASMA DISPLAY DEVICE AND DRIVING METHOD THEREOF

BACKGROUND OF THE INVENTION

1. Field of the Invention

The present invention relates to a plasma display device for providing gray-scale display by controlling the number of sub pixels to be turned ON out of sub pixels forming a pixel.

2. Description of the Related Art

Recently, information to be displayed is increasingly diversified and also a greater screen size and higher definition are increasingly implemented in equipments such as computer displays and televisions. In response to such trends, improved display quality is in high demand in the field of display devices used in those equipments (such as plasma display devices, LCDs (Liquid Crystal Displays), electroluminescence, fluorescent display tubes, and light emitting diodes).

Of the above display devices, the plasma display devices are actively developed in recent years because of their characteristics such as no flickering, easy to increase the screen size, high brightness, and long life time.

The plasma display devices are roughly divided into two types: a two-electrode plasma display device and a three-electrode plasma display device. The two-electrode plasma display device uses two electrodes to generate selective discharge (address discharge) for selecting cells to be turned ON from a plurality of light-emitting cells forming a display surface and sustain discharge for sustaining light emission of the selected light-emitting cells. The three-electrode plasma display device uses a third electrode to generate address discharge and uses the above two electrodes to generate sustain discharge.

Recently, plasma display devices capable of providing color display are also actively developed. Of such plasma display devices, a plasma display device capable of providing gray-scale display causes light emission by exciting a fluorescent material (which is formed in each light-emitting cell) having a luminescent color corresponding to one of the three primary colors of light by ultraviolet (UV) rays generated by discharge between the electrodes. However, the fluorescent material is susceptible to impact caused by bombardment of positively charged ions generated together with UV rays by discharge.

In the two-electrode plasma display device, ions directly bombard a fluorescent material. Therefore, the fluorescent material has a short life time.

In view of the above, a surface-discharge-type three-electrode plasma display device is becoming common in the art. In this plasma display device, ions generated by discharge do not bombard a fluorescent material.

The surface-discharge-type three-electrode plasma display device is divided into two types: a plasma display device in which a third electrode for generating address discharge is disposed on a substrate on which first and second electrodes for generating sustain discharge are disposed; and a plasma display device in which the third electrode is disposed on another substrate which faces the substrate on which the first and second electrodes are disposed.

In the plasma display device having the first to third electrodes on the same substrate, the third electrode may either be disposed above or below the two electrodes for generating sustain discharge.

There are also a transmission-type plasma display device and a reflection-type plasma display device. In the transmission-type plasma display device, light (visible light) emitted from a fluorescent material is transmitted through the fluorescent material to the outside. In the reflection-type plasma display device, light emitted from a fluorescent material is guided to the outside as reflected light from the fluorescent material.

A light-emitting cell for generating discharge is spatially separated from an adjacent light-emitting cell by a partition wall (which is also referred to as rib or barrier). The plasma display devices having this partition-wall structure are divided into two types. In one of the two types of plasma display devices, the partition wall entirely surrounds the four sides of each light-emitting cell in order to completely seal within the light-emitting cell a gas to be supplied for light emission. In the other type of plasma display device, the partition wall extends only in one direction, and adjacent light-emitting cells are separated from each other in the direction perpendicular to the one direction by providing an appropriate gap (distance) between electrodes.

Of the above three-electrode plasma display devices, a surface-discharge-type three-electrode AC (alternating current) plasma display device which has been commonly used in the art will now be described with reference to FIGS. 9 to 13. This plasma display device is disclosed in Japanese Laid-Open Publication No. 9-6283.

The following description will be given for a reflection-type surface-discharge three-electrode AC plasma display device (hereinafter, simply referred to as PDP (Plasma Display Panel)). In this PDP, first and second electrodes for generating sustain discharge are disposed in parallel on a substrate, and a third electrode for conducting address discharge is disposed in the direction perpendicular to the first and second electrodes on a substrate facing the above substrate. Moreover, the partition wall is disposed only in the direction perpendicular to the first and second electrodes for generating sustain discharge and parallel to the third electrode for generating address discharge. Each of the first and second electrodes is partially formed by a transparent electrode.

First, the schematic structure of the conventional PDP will be described with reference to FIGS. 9 to 11. FIG. 9 is a plan view of the conventional PDP 100.

Referring to FIG. 9, the PDP 100 includes address electrodes A1 to AM for generating address discharge and X-electrodes X1 to XN and Y-electrodes Y1 to YN for generating sustain discharge. The X-electrodes X1 to XN are connected to a common electrode, and the Y-electrodes Y1 to YN are independent of each other.

A fluorescent material corresponding to one of the three primary colors of light (red (R), green (G) and blue (B)) is applied in each light-emitting cell C. The Y-electrodes Y1 to YN are separated by partition walls 129 in the address-electrode direction.

A fluorescent material of the same color is applied in a space between adjacent two partition walls 129 so that the PDP 100 has repeated stripe patterns of fluorescent material having the colors of R, G, B.

Adjacent light-emitting cells C are separated from each other in the direction of the address electrodes A1 to AM by providing an appropriate gap (distance) between an X-electrode and a Y-electrode between the adjacent light-emitting cells C (e.g., X-electrode XN and Y-electrode YN-1).

In the PDP 100 having the above structure, address discharge is generated between the address electrode A1 to AM and the Y-electrode Y1 to YN, and sustain discharge is generated between each X-electrode X1 to XN and a corresponding adjacent Y-electrode Y1 to YN (e.g., X-electrode X1 and Y-electrode Y1, X-electrode X2 and Y-electrode Y2, and the like).

Hereinafter, the cross-sectional structure of the PDP 100 will be described with reference to FIGS. 10A and 10B. FIG. 10A is a partial cross-sectional view taken along line α–α' in FIG. 9 (a region associated with the address electrodes A4 to A6), and FIG. 10B is a partial cross-sectional view taken along line β–β' in FIG. 9 (a region associated with the Y-electrode Y1, the X-electrode X2 and the Y-electrode Y2).

As shown in FIGS. 10A and 10B, the PDP 100 is a reflection-type PDP. The address electrodes A1 to AM, the X-electrodes X1 to XN, the Y-electrodes Y1 to YN, the light-emitting cells C and the partition walls 129 are formed between a rear glass substrate 131 and a front grass substrate 106. The X-electrodes X1 to XN and the Y-electrodes Y1 to YN serve as sustain electrodes. As shown in FIG. 10A, the PDP 100 includes the following elements sequentially from its rear surface: the rear glass substrate 131; the address electrodes A1 to AM; the partition walls 129; a fluorescent material F; an MgO layer 102; a dielectric layer 103 such as glass; the X-electrodes X1 to XN; the Y-electrodes Y1 to YN; and the front glass substrate 106. The rear glass substrate 131 serves as a body of the PDP 100. The partition walls 129 separate the light-emitting cells C from each other. The fluorescent material F covers the address electrodes A1 to AM. The fluorescent material F has a luminescent color (R, G or B) corresponding to each light-emitting cell C, and emits light when being excited by UV rays generated by address discharge and sustain discharge. The MgO layer 102 serves as a protection layer for protecting a discharge surface from positive ions bombardment produced by address discharge and sustain discharge. The dielectric layer 103 insulates the X electrodes and the Y-electrodes from each other and forms a discharge surface. The front glass substrate 106 forms a display surface.

The rear glass substrate 131 and the front glass substrate 106 are laminated each other so that the top of the partition walls 129 closely contact the MgO layer 102.

As shown in FIG. 10B, each of the X-electrodes X1 to XN and the Y-electrodes Y1 to YN is formed by a transparent electrode 105 and a bus electrode 104.

The transparent electrode 105 is formed from ITO (Indium Tin Oxide, a transparent conductive film mainly containing indium oxide) in order to allow emitted light from the fluorescent material F to transmit therethrough. The bus electrode 104 is formed from a low-resistance material such as Cu (copper) or Cr (chromium) in order to prevent a voltage drop from being caused by an electric resistance.

In the above structure, emitted light from the fluorescent material F transmits through the transparent electrodes 105 and the front glass substrate 106 as reflected light and is discharged from the display surface to the outside. In display data to be displayed using the conventional PDP 100, each frame is formed by a plurality of sub frames (images), and each sub frame is divided into a reset period, an address period, and a sustain discharge period in a time-sharing manner.

The reset period is a period for resetting all light-emitting cells C of the PDP 100 in order to remove unnecessary charges. The address period is a period for generating address discharge (selective discharge; see FIGS. 10A and 10B) by applying an address pulse and a scan pulse along an address line to an address electrode A1 to AM and a Y-electrode Y1 to YN which correspond to light-emitting cells C to be turned ON, based on the data to be displayed.

The sustain discharge period is a period for applying a sustain pulse to the X-electrode X1 to XN and the Y-electrode Y1 to YN in order to enhance light emission of the light-emitting cells C turned ON by address discharge. The sustain pulse generates sustain discharge, whereby the light-emitting cells C emit light. As a greater number of sustain pulses is applied, brightness of the light-emitting cells C is increased.

Hereinafter, the structure of a conventional plasma display device including the PDP 100 will be described with reference to FIG. 11. In the plasma display device 200 of FIG. 11, the address electrodes A1 to AM are individually connected to an address driver 111. The address driver 111 applies an address pulse PAW and the like for generating address discharge. The Y-electrodes Y1 to YN are individually connected to a Y-scan driver 113.

The Y-scan driver 113 is connected to a Y-common driver 114. The Y-scan driver 113 generates a scan pulse PAY for generating address discharge. The Y-common driver 114 generates a sustain pulse PYS and the like in a sustain discharge period, and applies the sustain pulse PYS and the like to the Y-electrodes Y1 to YN through the Y-scan driver 113. The X-electrodes X1 to XN are connected to a common potential across all display lines of the PDP 100 and extended to the outside.

An X-common driver 112 generates a write pulse PXW in a reset period and generates a sustain pulse PXS in a sustain discharge period, and the like. These drivers are controlled by a control circuit 110.

The control circuit 110 includes a display data control section 120 and a panel drive control section 121. The display data control section 120 includes a frame memory 130 for storing data corresponding to a single frame of display data. The panel drive control section 121 includes a scan-driver control section 140 and a common-driver control section 141 for controlling a corresponding driver. The control circuit 110 outputs control signals for controlling each driver, based on external signals (a dot clock CLK, synchronization signals HSYNC, VSYNC and display data DATA).

Hereinafter, operation of the plasma display device 200 in a sub-frame period (a period corresponding to a single sub frame) will be described with reference to the timing chart of FIG. 12 and FIG. 11. FIG. 12 shows the timing of generating each pulse in a sub-frame period.

As shown in FIG. 12, all Y-electrodes Y1 to YN are set to 0 V and a write pulse PXW (about 330 V, 10 μsec) is applied to all X-electrodes X1 to XN in a reset period (which consists of an overall write period and a self-eraser discharge).

A write pulse PAW is applied to all address electrodes A1 to AM in synchronization with the write pulse PXW. These write pulses PXW, PAW generate discharge between all X-electrodes X1 to XN and all address electrodes A1 to AM (in all light-emitting cells C) regardless of the previous display state. After discharge is generated by the write pulses PXW, PAW, all X-electrodes X1 to XN and all address electrodes A1 to AM fall to 0 V. In all light-emitting cells C, a voltage of wall charges themselves exceeds a starting discharge voltage, whereby discharge is started. Since there is no potential difference between the electrodes, no wall charge is generated by the discharge, and the discharge is completed as a result of self-neutralization of space charges. This is so-called self-erase discharge.

A period from completion of application of the write pulse PXW to the X-electrodes X1 to XN until starting application of a voltage to the X-electrodes X1 to XN in the following address period is referred to as a self-eraser discharge TSE.

This self-erase discharge renders all light-emitting cells C in a uniform potential state having no wall charge, whereby reset operation is conducted. In the reset period, all light-emitting cells C are rendered in the same potential state regardless of their ON/OFF states in the previous sub-frame period. This ensures stable address discharge in the address period following the reset period.

In the address period, address discharge is generated in order to select light-emitting cells C to be turned ON based on sub-frame data. The address discharge is divided into priming address discharge and main address discharge. The priming address discharge is discharge for designating light-emitting cells, and the main address discharge is discharge for accumulating wall charges.

More specifically, in the priming address discharge, an address pulse PAA is applied to address electrodes corresponding to light-emitting cells C to be turned ON. In parallel with this, a scan pulse PAY is applied to Y-electrodes corresponding to the light-emitting cells C to be turned ON sequentially from the Y-electrode Y1 in a time-sharing manner (along an address line). The priming address discharge is thus generated by the address pulse PAA and the scan pulse PAY.

The address pulse PAA is applied to all address electrodes corresponding to the light-emitting cells C designated by sub-frame data corresponding to a single sub frame shown in the timing chart of FIG. 12.

As a result, the priming address discharge occurs simultaneously in the required ones of the light-emitting cells C corresponding to the Y-electrode. Since the scan pulse PAY is sequentially applied to the Y-electrodes, this operation is repeated in the light-emitting cells C corresponding to a Y-electrode of interest in response to the scan pulse PAY applied to each Y-electrode.

The priming address discharge and the main address discharge will now be described in more detail. First, a scan pulse PAY of −VY level (about −150 V) is applied to a Y-electrode of interest (e.g., Y-electrode Y1). At the same time, an address pulse PAA of a voltage Va (about 50 V) is applied to an address electrode corresponding to a light-emitting cell C to be turned ON. All X-electrodes X1 to XN are held at a predetermined X-address voltage ("VX" in FIG. 12). As a result, priming address discharge occurs between the Y-electrode Y1 and the address electrode A1. This priming address discharge serves as priming of main address discharge. Main address discharge thus occurs between the corresponding X-electrode X1 and the Y-electrode Y1 as discharge for accumulating wall charges.

The priming address discharge and the main address discharge accumulate wall charges on the MgO film 102 (see FIGS. 10A, 10B) covering the X-electrode and the Y-electrode corresponding to the light-emitting cell C to be turned ON (X-electrode X1 and Y-electrode Y1) in an amount which allows sustain discharge to be generated in the following sustain discharge period.

The above address discharge occurs sequentially in all Y-electrodes in response to every address pulse PAY, whereby data is written to the light-emitting cells C corresponding to the sub-frame data of a single sub frame.

Finally, in the sustain discharge period, sustain pulses PXS, PYS (about 180 V) are alternately applied to all X-electrodes and all Y-electrodes in order to enhance light emission of the light-emitting cells designated in the address period. As a result, sustain discharge exceeding a threshold value occurs in the designated light-emitting cells C (the light-emitting cells C having wall charges accumulated therein), whereby an image having a brightness corresponding to the sub-frame data is displayed. As described above, the brightness in the sub-frame period is increased as a greater number of sustain pulses PXS, PYS is applied.

Hereinafter, multi-gray-scale display of the plasma display device 200 including the above PDP 100 will be described. It is herein assumed that the plasma display device 200 provides display of 256 gray levels.

For display of 256 gray levels, each frame of display data is divided into eight sub frames (SF1 to SF8) in a time-sharing manner, as shown in FIG. 13. Wherein, the time-sharing manner and the time dither method have the same meaning.

Each sub frame has a reset period, an address period and a sustain discharge period. The reset period and the address period have respective constant lengths in every sub frame. The eight sub frames have the sustain discharge period at a length ratio of 1:2:4:8:16:32:64:128. Accordingly, selecting a sub frame to be turned ON enables the difference in brightness of to be displayed with 256 gray levels (i.e., 0 to 255).

For example, it is now assumed that 7/256 gray levels are to be displayed. Since 7 (gray level)=1 (gray level)+2 (gray level) and 4 (gray level), light is emitted only during a period corresponding to the sub frames SF1 to SF3, and no light is emitted in the remaining sub frames. Similarly, when 20/256 gray levels are to be displayed, 20 (gray level)=16 (gray level)+4 (gray level). Therefore, light is emitted only during a period corresponding to the sub frames SF3, SF5. The brightness of each sub frame is determined by the length of the sustain discharge period, that is, the number of sustain pulses.

An example of actual time allocation in each frame is as follows: provided that the display is rewritten at 60 Hz, each frame is 16.6 ms (1/60 Hz). If the number of sustain discharge cycles (hereinafter, sometimes referred to as "sustain cycles") per frame is 510, the number of sustain cycles of each sub frame is 2 for the sub frame SF1, 4 for the sub frame SF2, 8 for the sub frame SF3, 16 for the sub frame SF4, 32 for the sub frame SF5, 64 for the sub frame SF6, 128 for the sub frame SF7, and 256 for the sub frame SF8.

Provided that each sustain cycle is 8 μs, the total time of sustain cycles in each frame is 4.08 ms. Eight reset periods and eight address periods are allocated in the remaining period (about 12 ms). The reset period of each sub frame is 50 μs, and the time required for an address cycle (scanning per line) is 3 μs. Therefore, in the case of the PDP 100 having 480 display lines (Y-electrodes) in the vertical direction, 1.44 ms (3×480) is required for the address cycles.

Accordingly, in order to display 256 gray levels by display data of a single frame (sub frames SF1 to SF8), about 16 ms is required in total for the reset periods, the address periods and the sustain discharge periods.

Japanese Laid-Open Publication No. 2000-66637 describes a method for improving gray-scale display by using in combination a gray-scale display means for dividing each frame of display data into a plurality of sub frames in a time sharing manner and a gray-scale display means for forming a unit pixel by a plurality of pixels. This method will now be described.

In this method, each pixel is formed by minimum unit pixels of R, G, B, and each minimum unit pixel is formed by a plurality of pixels. In this case, each unit pixel can be formed by two, three or more pixels. In the case where each minimum unit pixel is formed by a multiplicity of pixels, resolution is necessarily reduced due to the limitation of reduction in pixel size. Accordingly, each unit pixel is desirably formed by about two pixels.

Provided that each unit pixel is formed by two pixels and a time dither method is not used, the following three gray levels are possible: "both pixels are turned ON (very bright)"; "one of the pixels is turned ON (bright)"; and "both pixels are turned OFF (dark)".

Conventionally, however, each of the minimum unit pixels of R, G, B is normally formed by a single pixel. Therefore, if the time dither method is not used, only the following two gray levels are possible: "the pixel is turned ON (bright)"; and "the pixel is turned OFF (dark)".

According to the technology described in Japanese Laid-Open Publication No. 2000-66637, the number of unit pixels to be turned ON is controlled in a stepwise manner. This enables a greater number of gray levels to be displayed as compared to the conventional examples.

The above gray-scale display method can be used in combination with a gray-scale display method based on the time dither method in which each field is divided into a plurality of sub frames and a desired pixel is turned ON during a period of a desired sub frame.

Hereinafter, the above technology will be described in more detail with reference to the figures.

FIG. 14 shows the structure of the conventional plasma display device. This plasma display device 100 includes an AC-type PDP 100 and a drive unit 85. The PDP 100 is a matrix-type color display device. The drive unit 85 selectively turns ON the light-emitting cells C forming a screen SC. The light-emitting cells C are arranged in a matrix.

The PDP 100 is a surface-discharge type three-electrode PDP. More specifically, in the PDP 100, two pairs of first and second main-discharge electrodes (e.g., X-electrode X2N-1, Y-electrode Y2N-1 and X-electrode X2N, Y-electrode Y2N) are provided in parallel in every row. In each cell C, the X-electrode and the Y-electrode cross a corresponding address electrode AM (third electrode). Each unit pixel is formed by two pixels.

The X-electrode X2N-1, the Y-electrode Y2N-1, the X-electrode X2N and the Y-electrode Y2N extend in the row direction (horizontal direction) of the screen. The Y-electrodes Y2N-1, Y2N are used as scan electrodes for selecting light-emitting cells C on a row-by-row basis in an address period. The address electrodes AM extend in the column direction (vertical direction), and are used as data electrodes for selecting light-emitting cells C on a column-by-column basis. The region where the X-electrode group XN and the Y-electrode group YN cross the address electrode group AM is a display region, that is, the screen SC.

The drive unit 85 has a controller 110, a frame memory 122, a data processing circuit 120, a sub-field memory 124, a power supply circuit 46, an X-driver 112, a Y-driver 113 and an address driver 111. Field data and various synchronization signals are applied from an external device (such as a television (TV) tuner and a computer) to the drive unit 85. The field data indicates the brightness level (gray level) of each color (R, G, B) on a pixel-by-pixel basis.

The field data is first stored in the frame memory 122 and then transmitted to the data processing circuit 120. The data processing circuit 120 is a data conversion means for dividing each field into a predetermined number of sub frames in order to provide gray-scale display and determining a combination of sub frames to be turned ON. The data processing circuit 120 outputs sub-frame data Dsf corresponding to the field data. The sub-frame data Dsf is stored in the sub-field memory 124. The value of each bit of the sub-frame data Dsf represents information indicating whether a cell is to be turned ON or not in a sub frame. To be exact, the value of each bit of the sub-frame data Dsf represents information indicating whether address discharge is required or not.

The X-driver 112 applies a drive voltage to the X-electrode group XN, and the Y-driver 113 applies a drive voltage to the Y-electrode group YN. The address driver 111 applies a drive voltage to the address electrodes AM according to the sub-frame data Dsf. The power supply circuit 46 supplies predetermined power to these drivers.

FIG. 15 is a perspective view showing the internal structure of the PDP 100. On the inner surface of a front glass substrate 106 of the PDP 100, two pairs of first and second electrodes (e.g., X-electrode X2N-1, Y-electrode Y2N-1 and X-electrode X2N, Y-electrode Y2N) are provided in every row L. Each row L is a cell train in the horizontal direction of the screen. The X-electrodes X and the Y-electrodes Y are formed by a transparent conductive film 105 and a metal film (bus conductor) 104, and are covered with a dielectric layer 103 having a thickness of about 30 μm. The transparent conductive film 105 is formed from ITO, the metal film 104 is formed from Cr—Cu—Cr, and the dielectric layer 103 is formed from low melting-point glass.

A protection film 102 having a thickness of several thousands of angstroms is provided on the surface of the dielectric film 103. The protection film 102 is formed from magnesia (MgO). The address electrodes A are provided on an underlying layer 132 which covers the inner surface of a rear glass substrate 131, and are covered with a dielectric layer 134 having a thickness of about 10 μm.

A partition wall 129 having a height of 150 μm is provided on the dielectric layer 134 at a position between the address electrodes A. Each partition wall 129 has a linear band shape when viewed two-dimensionally. These partition walls 129 define individual discharge spaces 135 in the row direction on a sub-pixel-by-sub-pixel basis, and also define the dimension of the gap between the discharge spaces 135. Note that the sub pixel is a unit light-emitting region.

For color display, fluorescent material layers 128R, 128G, 128B of three colors (R, G, B) cover the inner surface of the rear glass substrate 131 (including the side surfaces of the partition walls 129 and the portions above the address electrodes A). Each of the fluorescent material layers 128R, 128B, 128B has a stripe pattern so that the cells in the same column have the same luminescent color and the cells in adjacent columns have different luminescent colors.

For improved contrast, it is desirable to color the top portions of the partition walls 129 with a dark color and to color the other portions thereof with white so as to increase the reflectance of visible light. The partition walls 129 are colored by adding a pigment of a predetermined color to glass paste, a material of the partition walls 129.

The discharge spaces 135 are filled with a discharge gas (charged pressure: 500 Torr). The discharge gas is a mixture of neon (a main component) and xenon. When discharge occurs, UV rays are generated by xenon. As a result, the fluorescent material layers 128R, 128G, 128B are locally excited by the UV rays and emit light. Each pixel for display is formed by a total of six sub pixels arranged in two rows. More specifically, each pixel for display is formed by three sub pixels arranged in a row and three sub pixels arranged in an adjacent row. The structural element in each sub pixel is a light-emitting cell (display element) C. Since the partition walls 129 are arranged with a stripe pattern, every discharge space 135 continuously extends in the column direction over all rows L.

Therefore, the dimension of the electrode gap between adjacent rows L (which is called "reverse slit") is sufficiently larger than the surface discharge gap of each row L (e.g., in the range of 80 to 140 μm). The electrode gap has a value that prevents discharge coupling in the column direction (e.g., in the range of 200 to 500 μm).

Note that a not-shown light-shielding film is provided on the outer surface or inner surface of the glass substrate 106 along each reverse slit in order to hide a non-luminous whitish fluorescent material layer.

FIG. 16 specifically illustrates the structure of the PDP 100. As shown in FIG. 16, each unit pixel is formed by fluorescent material layers 128R, 128G, 128B of three colors (R, G, B) in the horizontal direction, and is formed by two electrode pairs (i.e., a first electrode pair X1, Y1 and a second electrode pair X2, Y2) in the vertical direction. Therefore, each unit pixel is formed by six sub pixels (i.e., two R-sub pixels, two G-sub pixels, and two B-sub pixels).

In the illustrated example, each unit pixel is formed by two display electrode pairs. However, each unit pixel may alternatively be formed by three, four or more display electrode pairs.

The above electrode arrangement enables reduction in individual discharge, thereby improving luminous efficiency over the conventional PDP in which each unit pixel is formed by a single display electrode pair.

FIGS. 17A to 17C illustrate the ON/OFF state of two sub pixels of each color (R, G, B). As shown in FIGS. 17A to 17C, the following three brightness levels are possible for two sub pixels of each color (R, G, B): both cells are turned ON (brightness level 2) (see FIG. 17A); one of the two cells is turned ON (brightness level 1) (see FIG. 17B); and both cells are turned OFF (brightness level 0) (see FIG. 17C).

Since the three brightness levels are possible, display of a greater number of gray levels can be provided as compared to the case where a PDP having unit pixels each formed by three sub pixels of R, G, B is driven by the time dither method.

More specifically, when the time dither method is applied to the PDP having unit pixels each formed by three sub pixels R, G, B, each field is divided into a plurality of sub frames, and the sub frames have a length ratio of 1:2:4:8:16 . . . . Therefore, if each frame is divided into n sub frames, $2^n$ gray levels are obtained.

On the other hand, when the time dither method is applied to the conventional PDP, each field is divided into a plurality of sub frames, and the sub frames have a length ratio of 1:3:9:27:81 . . . . Therefore, if each frame is divided into n sub frames, $3^n$ gray levels are obtained.

For example, if each field is divided into four sub frames, five sub frames and six sub frames, display of 81 gray levels, 243 gray levels and 729 gray levels is possible, respectively.

In this case, the same effects as those obtained by a dither method are obtained. In the dither method, however, gray-scale display is provided by a plurality of pixels, thereby reducing the resolution of the screen. On the other hand, in the above conventional method, gray-scale display is provided by a single pixel. Therefore, the resolution of the screen is not reduced.

If the number of discharge electrodes is increased, the write time of each sub field is increased as compared to the PDP having unit pixels each formed by three sub pixels of R, G, B. Therefore, when the time dither method is used, the number of sub frames must be reduced as compared to the conventional example, whereby the number of gray levels is reduced. In the above conventional method, however, gray-scale display is provided by a single pixel. Therefore, the number of gray levels is not reduced even if the number of sub frames is reduced. Moreover, since the density of points whose ON/OFF state is controlled is increased, the spatial frequency of the image is increased, which contributes to improvement in apparent image quality.

In the illustrated example, each unit pixel is formed by two display electrode pairs. However, each unit pixel may alternatively be formed by three, four or more display electrode pairs, as described above.

Greater screen size and higher definition are highly expected for the plasma display devices.

However, 256 gray levels are the limit of gray-scale display even in a VGA (Video Graphics Array)-standard plasma display device having 480 display lines (Y-electrodes) in the vertical direction as disclosed in Japanese Laid-Open Publication No. 9-6283.

Japanese Laid-Open Publication No. 11-133912 describes a plasma display device capable of implementing a greater number of gray levels and higher definition. In this plasma display device, the display screen is divided into upper and lower display screens, and these upper and lower display screens are simultaneously scanned by using two independent scan-pulse generating means.

However, since the display screen is divided into the upper and lower display screens, a difference is produced between a voltage applied to an upper anode driving section and a voltage applied to a lower anode driving section. This causes a difference in a discharge current for gray-scale display between the upper and lower display screens. Therefore, the resultant gray-scale display becomes non-uniform along the boundary between the upper and lower display screens.

The gray-scale display means disclosed in Japanese Laid-Open Publication No. 2000-66637 has a plurality of sub pixels (k sub pixels) in the column direction. Therefore, the number of scanning lines required to scan all sub pixels in the column direction is increased to N (scanning lines)×k (sub pixels), thereby increasing the total address period. As a result, there is a limit in improvement in definition and the number of gray levels.

It is now assumed that video signal data according to the VGA standard (480 display lines (480 pixels) in the vertical direction) is displayed with a total of 243 gray levels by using both a gray-scale display means of three gray levels and a gray-scale display means based on the time dither method. In the former gray-scale display means, each of the pixels of R, G, B in the column direction is formed by two sub pixels. In the latter gray-scale display means, each frame is formed by five sub frames and the sub frames have a length ratio of 1:3:9:27:81.

| | |
|---|---|
| Each sustain cycle period: | 8 μs |
| Number of sustain cycles pergray level: | 2 cycles |
| Each reset period: | 50 μs |
| Each address cycle period: | 3 μs |

In this case, the total period required to provide 8-bit gray-scale display of VGA-standard video signal data of a single frame is given by the following equation (4):

$$\text{Reset period}=0.25\ \text{ms} \quad (1)$$

$$\text{Address cycle period}=14.4\ \text{ms} \quad (2)$$

$$\text{Sustain cycle period}=1.94\ \text{ms} \quad (3)$$

$$\text{A frame period required for 243 gray-level display}=16.59\ \text{ms} \quad (4)$$

It can be appreciated from the equation (4) that the plasma display device having 480 pixels in the column direction cannot provide more than 243 gray-level display. In other words, higher definition and a greater number of gray levels are not implemented.

It is now assumed that video signal data according to VGA standard (480 display lines (480 pixels) in the vertical direction) is displayed with a total of 729 gray levels by using both a gray-scale display means of three gray levels and a gray-scale display means based on the time dither method. In the former gray-scale display means, each of the pixels of R, G, B in the vertical direction is formed by two sub pixels. In the latter gray-scale display means, each frame is formed by six sub frames, and the sub frames have a length ratio of 1:3:9:27:81:243.

$$\text{Reset period}=0.3\ \text{ms} \tag{5}$$

$$\text{Address cycle period}=17.28\ \text{ms} \tag{6}$$

$$\text{Sustain cycle period}=5.82\ \text{ms} \tag{7}$$

$$\text{A frame period required for 729 gray-level display}=23.40\ \text{ms} \tag{8}$$

In this case, the frame period required for 729 gray-level display (23.40 ms) exceeds a standard one-field period (about 16.6 ms) of a video signal.

In other words, the gray-scale display means disclosed in Japanese Laid-Open Publication No. 2000-66637 do not provide a solution to implement higher definition and a greater number of gray levels in the PDP, and can implement the number of gray levels and definition at most as the same level as that in the existing technologies.

SUMMARY OF THE INVENTION

It is an object of the present invention to provide a plasma display device capable of implementing both a greater number of gray levels and higher definition.

In the description of the present invention, a plasma display device which has 680×3 (R (red), G (green), B (blue)) unit pixels in the X-electrode direction and 480 unit pixels in the address-electrode direction and includes a gray-scale display means having a 8-bit gray-scale display means based on a time dither method will be used as a reference. In the plasma display device of the reference, the time required to provide gray-scale display of all pixels of a single field is about 16 ms per frame period, provided that each sustain cycle period is 8 μs, the number of sustain cycles per gray level is two cycles, each reset period is 50 μs, and each address cycle period is 3 μs.

According to one aspect of the present invention which provides a solution to implement a greater number of gray levels and higher definition, a plasma display device has pixels each formed by a plurality of sub pixels of the same color provided in an address-electrode direction, and provides gray-scale display by controlling the number of sub pixels to be turned ON. In this plasma display device, a plurality of address electrodes are provided for each sub pixel. Each sub pixel is addressed by a conductive layer which is electrically connected to one of the plurality of address electrodes.

The "sub pixel" generally refers to an element cell forming a pixel, and corresponds to a light-emitting cell in the conventional example. In the present invention, the expression "a plurality of sub pixels" is used instead of "a plurality of unit pixels". Each sub pixel has a conductive layer connected to one of a plurality of address electrodes. Each sub pixel may be used as a pixel. In this case, a video signal corresponding to the position of the pixel in the X-electrode direction may be applied to the sub pixel.

In the present invention, a set of light-emitting cells is referred to as sub pixels, pixels and picture elements according to the type of means for implementing a greater number of gray levels. Note that the minimum number of sub pixels whose ON/OFF state is controlled is 1, and each pixel may be formed by a single sub pixel.

According to the above structure of the present invention, a plurality of lines can be simultaneously addressed, whereby the address time per scanning line is reduced. As a result, higher definition of the pixels in the vertical direction can be implemented as well as a greater number of gray levels can be displayed by controlling the number of sub pixels of the vertical direction to be turned ON.

According to another aspect of the present invention, a plasma display device has pixels each formed by a plurality of sub pixels of the same color provided in an address-electrode direction and an X-electrode direction, and provides gray-scale display by controlling the number of sub pixels to be turned ON. In this plasma display device, a plurality of address electrodes are provided for each sub pixel. Each sub pixel is addressed by a conductive layer which is electrically connected to one of the plurality of address electrodes.

For simplicity of the description, a plasma display device having unit pixels each formed by two sub pixels provided in the horizontal direction is herein considered.

Provided that every sub pixel has the same amount of gray-scale display, three gray levels can be displayed by controlling ON/OFF state of two sub pixels. If the gray-scale display means is used in combination with a 7-bit gray-scale display means based on the time dither method, 384 gray levels can be displayed in total.

A frame period required for this gray-scale display is 13.36 ms. Therefore, the number of scanning lines can be increased up to (480×about 1.3) while maintaining the 384 gray-level display.

According to the above structure of the present invention, higher definition and a greater number of gray levels can be arbitrarily implemented not only in the vertical direction but also in the horizontal direction.

Note that the minimum number of sub pixels whose ON/OFF state is controlled is 1, and each pixel may be formed by a single sub pixel.

According to still another aspect of the present invention, a plasma display device includes a plurality of sub pixels provided adjacent to each other. An electrode extends with the same length in each of the plurality of sub pixels in a direction in which the plurality of sub pixels are arranged.

According to yet another aspect of the present invention, a plasma display device includes a plurality of sub pixels provided adjacent to each other. The plurality of sub pixels include two types of sub pixels in which an electrode extends with different lengths in a direction in which the plurality of sub pixels are arranged.

According to the above structure of the present invention, gray-scale display is provided by controlling the number of sub pixels to be turned ON or a combination of sub pixels to be turned ON. Therefore, higher definition and a greater number of gray levels can be easily implemented with a smaller number of address electrodes and a smaller pixel size. More specifically, this means that a plurality of sub pixels provides gray-scale display at different brightness levels in the same sustain discharge period following the address period. Therefore, the above expression has the same meaning as the expressions "providing a difference in bright level" and "having a plurality of bright levels".

It is now assumed that each pixel is formed by two sub pixels (SPC1, SPC2) having a bright-level ratio of 1:2. In this case, four gray levels are displayed in each pixel by controlling the number of sub pixels to be turned ON. If the gray-scale display means is used in combination with a 7-bit gray-scale display means based on the time dither method, 512 gray levels can be displayed in total.

Moreover, the number of scanning lines can be increased up to about 1.3 times the number of scanning lines (480 lines) in the plasma display device of the reference. Therefore, a plasma display device capable of implementing a greater number of gray levels and higher definition can be provided.

If a means for providing a difference in bright level to the sub pixels is implemented by providing a plurality of sub pixels having different electrode lengths, partition walls can be eliminated. This enables reduction in size of a unit pixel.

According to a further aspect of the present invention, a plasma display device has pixels each formed by a plurality of sub pixels provided in an address-electrode direction, and provides gray-scale display by controlling the number of sub pixels to be turned ON. In this plasma display device, a difference in bright level is provided by two types of sub pixels having different electrode structures, i.e., a sub pixel having a single X-electrode and a single Y-electrode and a sub pixel having two X-electrodes and a single Y-electrode.

According to the above structure of the present invention, the same gray level of the pixel can be obtained with a smaller number of Y-electrodes (and a smaller number of scanning lines) as compared to the conventional example. Moreover, pixel size can be reduced without increasing the number of scanning lines so much. Accordingly, a greater number of gray levels can be easily implemented.

Preferably, the gray-scale display provided by controlling the number of sub pixels to be turned ON is provided by controlling the number of sub pixels of the X-electrode direction to be turned ON and the number of sub pixels of the address-electrode direction to be turned ON.

According to the above structure of the present invention, the gray-scale display means includes a means for controlling in a stepwise manner the number of sub pixels of the horizontal direction to be turned ON and the number of sub pixels of the vertical direction to be turned ON. Therefore, a greater number of gray levels and higher definition can be implemented in both horizontal and vertical directions.

Preferably, gray-scale display is performed according to input data in combination with the gray-scale display provided by controlling the number of sub pixels to be turned ON in each pixel formed by a plurality of sub pixels and gray-scale display based on a time dither method in which each filed is divided into a plurality of sub frames and each sub pixel is controlled to be or not to be turned ON in each sub frame.

The above structure of the present invention uses both the gray-scale display means based on the time dither method and the gray-scale display means for controlling the number of sub pixels to be turned ON. Therefore, a greater number of gray levels and higher definition can be easily implemented in both row and column directions (horizontal and vertical directions).

According to a still further aspect of the present invention, in a method for driving a plasma display device, the plasma display device has picture elements each formed by first and second pixels provided adjacent to each other in an X-electrode direction. Each of the first and second pixels is formed by sub pixels of R, G, B provided adjacent to each other in the X-electrode direction. A gray-scale signal corresponding to a first pixel of a picture element is applied to a plurality of sub pixels in the first pixel of the picture element. A gray-scale signal of a function of the gray-scale signal corresponding to the first pixel of the picture element and a gray-scale signal corresponding to a first pixel of an adjacent picture element, i.e., a picture element located adjacent to a second pixel of the picture element, is applied to a plurality of sub pixels in the second pixel of the picture element.

According to a yet further aspect of the present invention, in a method for driving a plasma display device, the plasma display device has picture elements each formed by first and second pixels provided adjacent to each other in an X-electrode direction. Each of the first and second pixels is formed by sub pixels of R, G, B provided adjacent to each other in the X-electrode direction. Sub pixels of R, G, B are turned ON/OFF by applying a gray-scale signal corresponding to a position of a first pixel of a picture element to each of sub pixels of R, G, B in the first pixel of the picture element, and applying to each of sub pixels of R, G, B in a second pixel of the picture element an average of a gray-scale signal which is applied to a corresponding one of the sub pixels of R, G, B in the first pixel of the picture element and a gray-scale signal which is applied to a corresponding one of sub pixels of R, G, B in a first pixel of an adjacent picture element, i.e., a picture element located adjacent to the second pixel.

In the above plasma display device, each picture element is formed by a pair of adjacent pixels, and each of the pixels is formed by sub pixels of R, G, B provided in the X-electrode direction. In each pixel, only one sub pixel provides gray-scale display according to a video signal correctly applied thereto as a gray-scale signal, and the other sub pixels provide gray-scale display at a brightness level different from that of the video signal. Note that each pixel may be formed by any number of sub pixels (two or more). The above structure enables image display in the horizontal direction to be changed smoothly. Therefore, a high-definition plasma display device capable of displaying a large number of gray levels can be provided.

The foregoing and other objects, features, and advantages of the present invention will become more apparent from the following detailed description of the present invention when taken in conjunction with the accompanying drawings.

BRIEF DESCRIPTION OF THE DRAWINGS

FIGS. 17A, 17B and 17C illustrate the ON/OFF state of two sub pixels of each color (R (red), G (green), B (blue)) in a conventional PDP, wherein FIG. 17A shows the case where two cells are turned ON, FIG. 17B shows the case where one of the two cells is turned ON, and FIG. 17C shows the case where two cells are turned OFF.

DETAILED DESCRIPTION OF THE PREFERRED EMBODIMENTS

Hereinafter, embodiments of the present invention will be described.

(Device structure)

First, the structure of a plasma display device according to each embodiment of the present invention will be described with reference to FIG. 1.

Figure 1:
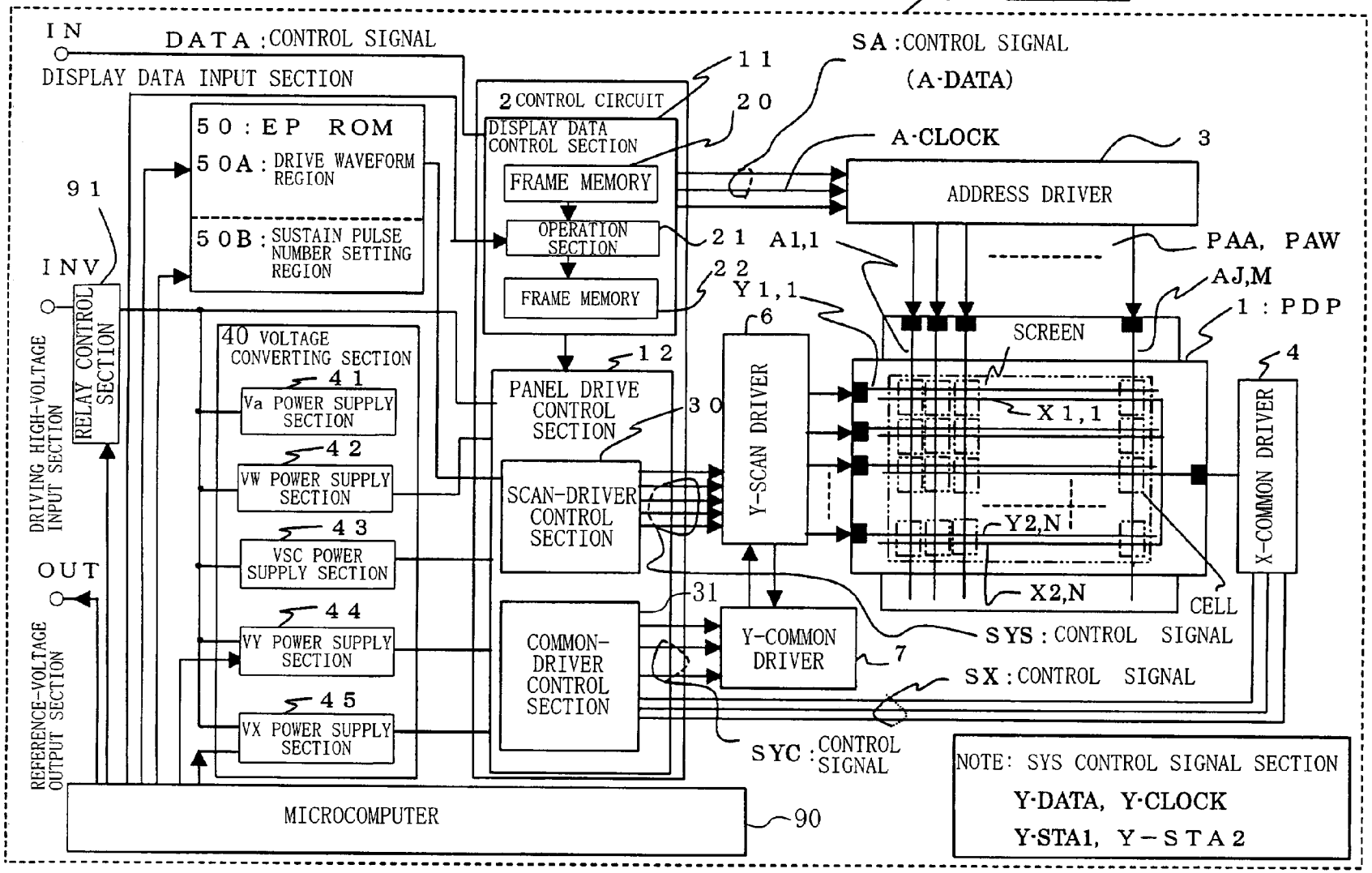
FIG. 1 is a schematic block diagram showing the structure of a plasma display device and illustrating operation of a PDP of the present invention.

As shown in FIG. 1, the plasma display device 200 according to each embodiment of the present invention includes a PDP 1 having the structure described above, an address driver 3, an X-common driver 4, a Y-scan driver 6, a Y-common driver 7, a control circuit 2, a voltage converting section 40, an EP-ROM (Erasable and Programmable Read Only Memory) 50, a relay control section 91, and a microcomputer 90. The address driver 3 applies an address pulse PAA and a write pulse PAW to address electrodes A1,1 to AJ,M based on a control signal from the control circuit 2. The X-common driver 4 is a drive means for applying a write pulse and a sustain pulse to X-electrodes X1,1 to X2,N based on a control signal SX from the control circuit 2. The Y-scan driver 6 is a drive means for applying a scan pulse to Y-electrodes Y1,1 to Y2,N based on a control signal SYS from the control circuit 2. The Y-common driver 7 is a drive means for applying a sustain pulse to the Y-electrodes Y1,1 to Y2,N through the Y-scan driver 6 based on a control signal SYC from the control circuit 2. The control circuit 2 is a control means for controlling driving of the PDP 1 based on predetermined signals (dot clock, display data DATA, vertical synchronization signal, horizontal synchronization signal and the like) under the control of the microcomputer 90. The voltage converting section 40 conducts voltage conversion of high-voltage power received from a driving high-voltage input section INV for each pulse to be applied to the PDP 1 under the control of the microcomputer 90. The EP-ROM 50 has a drive waveform region 50A and a sustain pulse number setting region 50B. The driver waveform region 50A prestores a waveform of each pulse to be applied to the PDP 1, and outputs a waveform of a desired pulse under the control of the microcomputer 90. The sustain pulse number setting region 50B determines the number of sustain pulses. The relay control section 91 is an inhibiting means for inhibiting application of a high voltage to the voltage converting section 40 and the control circuit 2 under the control of the microcomputer 90. The microcomputer 90 serves as a brightness control means, a voltage control means and a signal control means for generally controlling the plasma display device S1.

In the above structure, control signals SA, SYS, SYC, SX and high-voltage power for driving each driver are applied to each driver. The display data DATA is input from the outside through a display data input section IN.

The control circuit 2 includes a display data control section 11 and a panel drive control section 12. The display data control section 11 divides field data corresponding to a single field in the display data DATA into a plurality of sub frame data in a time sharing manner based on the dot clock and the display data DATA (which is divided in advance into data corresponding to R (red), G (green), B (blue)) under the control of the microcomputer 90, and outputs a control signal SA based on the sub-frame data. The panel drive control section 12 outputs control signals SX, SYS, SYC based on the vertical synchronization signal and the horizontal synchronization signal under the control of the microcomputer 90.

The display data control section 11 and the panel drive control section 12 transmit and receive required data to and from each other.

The display data control section 11 includes frame memories 20, 22 and an operation section 21. The frame memories 20, 22 temporarily store the input display data DATA on a field-by-field basis. The operation section 21 obtains correlation of gray scale between display data and corrects a gray level under the control of the microcomputer 90.

The microcomputer 90 is connected to the display data control section 11. The display data control section 11 calculates a gray-level value of each light-emitting cell C based on an operation coefficient received from the microcomputer 90. The gray-level value can thus be controlled by the microcomputer 90.

Therefore, gray-scale control can be conducted without changing a high-voltage system. For example, if control is conducted by the microcomputer and the like, various types of gray-scale control can be implemented by merely changing software.

The panel drive control section 12 includes a scan-driver control section 30 and a common-driver control section 31. The scan-driver control section 30 outputs a control signal SYS based on a scan pulse included in the sub-frame data of the display data control section 11, a vertical synchronization signal and a horizontal synchronization signal. The common-driver control section 31 outputs control signals SYC, SX based on the number of sustain pulses included in the sub-frame data of the display data control section 11, a vertical synchronization signal and a horizontal synchronization signal.

The voltage converting section 40 includes a Va power supply section 41, a VW power supply section 42, a VSC power supply section 43, a VY power supply section 44, and a VX power supply section 45. Based on high-voltage power received from a not-shown external high-voltage generator through the driving high-voltage input section INV, the Va power supply section 41 generates high-voltage power to the be supplied to the address electrodes A1,1 to AJ,M in order to generate a write pulse PAW and an address pulse PAA. Based on the high-voltage power received from the driving high-voltage input section INV, the VW power supply section 42 generates high-voltage power to be supplied to the X-electrodes X1,1 to X2,N in order to generate a write pulse. Based on the high-voltage power received from the driving high-voltage input section INV, the VSC power supply section 43 generates high-voltage power to be supplied to the Y-electrodes Y1,1 to Y2,N in order to generate main address discharge (discharge for accumulating wall charges) in an address period. Based on the high-voltage power received from the driving high-voltage input section INV, the VY power supply section 44 generates high-voltage power to be supplied to the Y-electrodes Y1,1 to Y2,N under the control of the microcomputer 90 in order to generate a scan pulse in an address period. Based on the high-voltage power received from the driving high-voltage input section INV, the VX power supply section 45 generates high-voltage power (X-address voltage) to be supplied to the X-electrodes X1,1 to X2,N under the control of the microcomputer 90 in order to generate main address discharge (discharge for accumulating wall charges) in an address period.

The microcomputer 90 is connected to a reference-voltage output section OUT for outputting a reference voltage of a sustain discharge voltage (a voltage of a sustain pulse). Accordingly, the microcomputer 90 can control a not-shown external high-voltage generator for generating a sustain discharge voltage and thus control a voltage of the power received from the driving high-voltage input section INV in order to control a sustain discharge voltage.

The microcomputer 90 is also connected to an address selection terminal of the EPROM 50 storing a plurality of numbers of sustain discharge pulses. The number of sustain discharge pulses can thus be controlled by the microcomputer 90. The number of sustain discharge pulses of each sub frame is predetermined with respect to the number of reference sustain pulses. Based on the predetermined number of sustain discharge pulses of each sub frame, the reference sustain pulses are output to the panel drive control section 12 as the number of sustain pulses in that sub frame. The common-driver control section 31 in the panel drive control section 12 outputs sustain pulses corresponding to the number of sustain pulses.

Operation of the relay control section 91 will now be described. For example, when an ambient environment temperature of the PDP 1 is abnormally high or when an unexpected trouble occurs, the temperature of the plasma display device S1 including the PDP 1 may rise abnormally. If the temperature of the plasma display device S1 exceeds a rated temperature of a circuit element, the circuit element may possibly be destroyed. In such a case, power supply to the plasma display device S1 is discontinued as soon as the temperature of the PDP 1 or the like reaches a certain preset temperature that may lead to an abnormal mode.

This operation will now be described in more detail. The inner temperature of the plasma display device S1 is detected by a detector (not-shown) for detecting the surface temperature of the PDP 1, a detector (not shown) for detecting the temperature of the X-common driver 4 and the Y-common driver 7, and a detector (not shown) for detecting the temperature of an atmosphere in the device.

When it is determined from the detection signals of the above temperature detectors that at least one of the above temperatures exceeds a corresponding predetermined threshold value, the microcomputer 90 operates the relay control section 91 in order to temporarily disconnect a driving high-voltage line. This operation is continued until all temperatures become less than the respective threshold values. Appropriate threshold values are as follows: about 90° C. for the surface temperature of the PDP 1; about 130° C. for the temperature of the X-common driver 4 and the temperature of the Y-common driver 7; and about 80° C. for the temperature of an atmosphere in the device.

As has been described above, if the temperature of an element such as the PDP 1 rises to a predetermined value or more, operation of the element can be stopped. As a result, the element and the like can be protected from abnormal operation resulting from such temperature rise.

Hereinafter, the PDP 1 according to each embodiment of the present invention will be described in detail based on the above plasma display device S1 of each embodiment.

First Embodiment

In the plasma display device of the first embodiment, each pixel is formed by a plurality of sub pixels of the same color provided in the address-electrode direction. This plasma display device provides gray-scale display by controlling the number of sub pixels to be turned ON. In this plasma display device, a plurality of address electrodes are provided for each sub pixel, and each sub pixel is addressed by a second conductive layer 108 which is electrically connected to one of the plurality of address electrodes. The plasma display device of the first embodiment thus provides a solution to implement a greater number of gray levels and higher definition.

The structure of the first embodiment will now be described with reference to FIG. 2.

Figure 2:
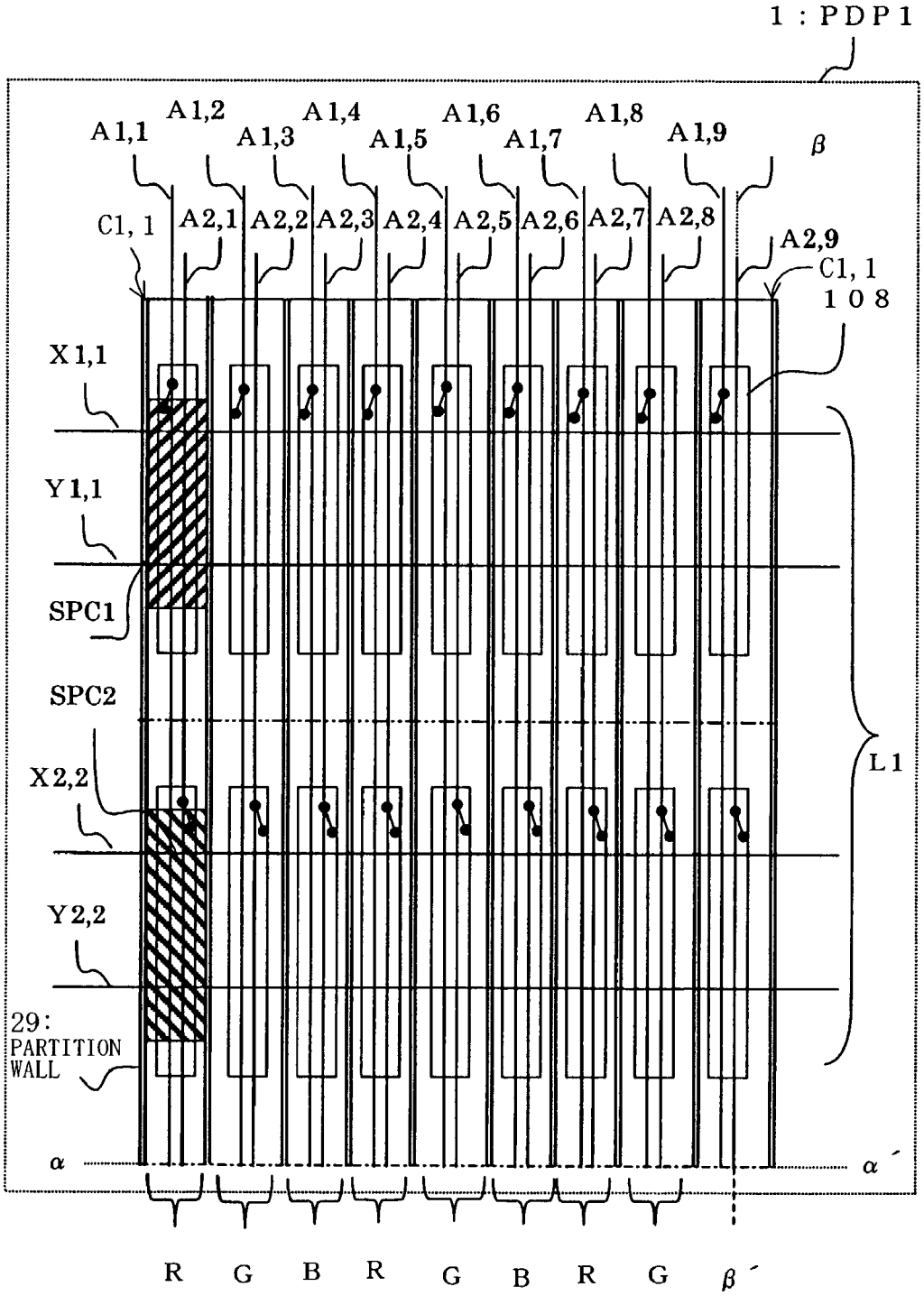
FIG. 2 is an enlarged partial schematic plan view of a PDP according to a first embodiment of the present invention.

FIG. 2 is an enlarged partial schematic plan view showing the region of sub pixels SPC1, SPC2 of pixels C1,1 to C9,1 in the PDP 1.

Each pixel CM,N of the PDP 1 is formed by two sub pixels provided in the address-electrode direction (where M is in the range of 1 to 680×3, and N is in the range of 1 to 480). Address electrodes AJ,M (where J is 1 or 2; therefore, a total of two address electrodes), an X-electrode Xk,N, and a Y-electrode Yk,N are provided for each sub pixel.

Figure 3A:
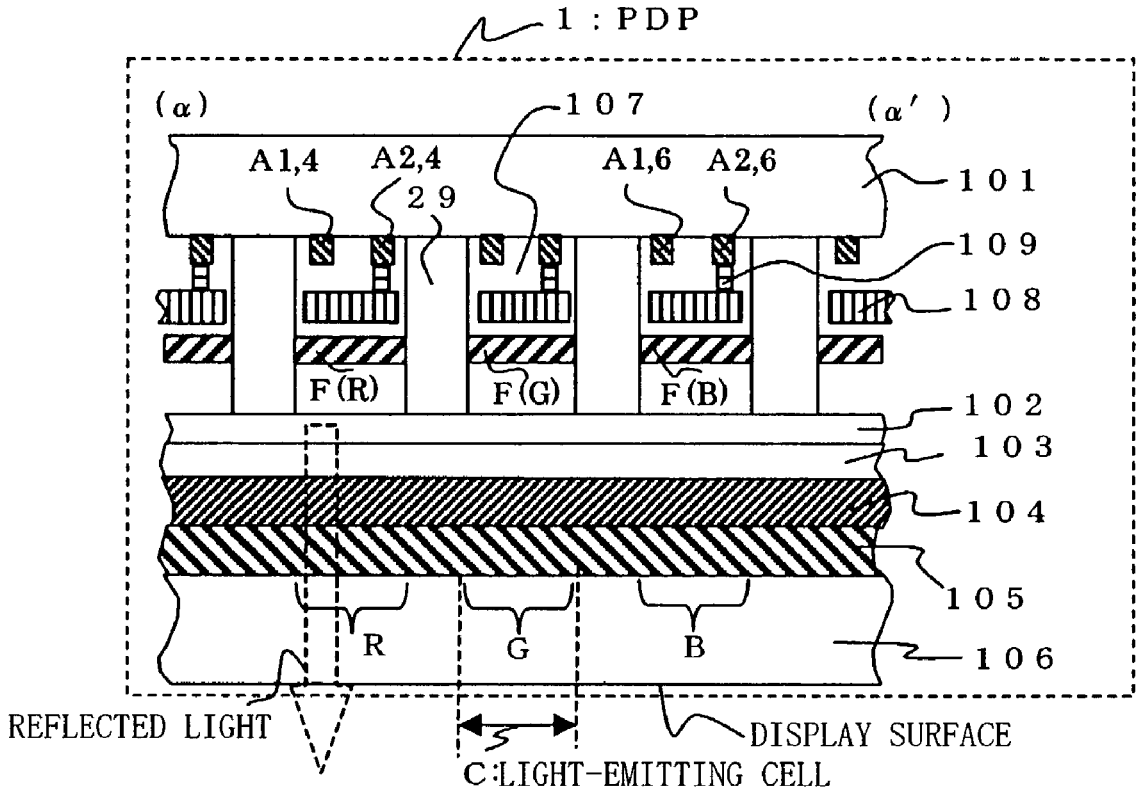
FIG. 3A is a cross-sectional view taken along line α–α' in FIG. 2.
Figure 3B:
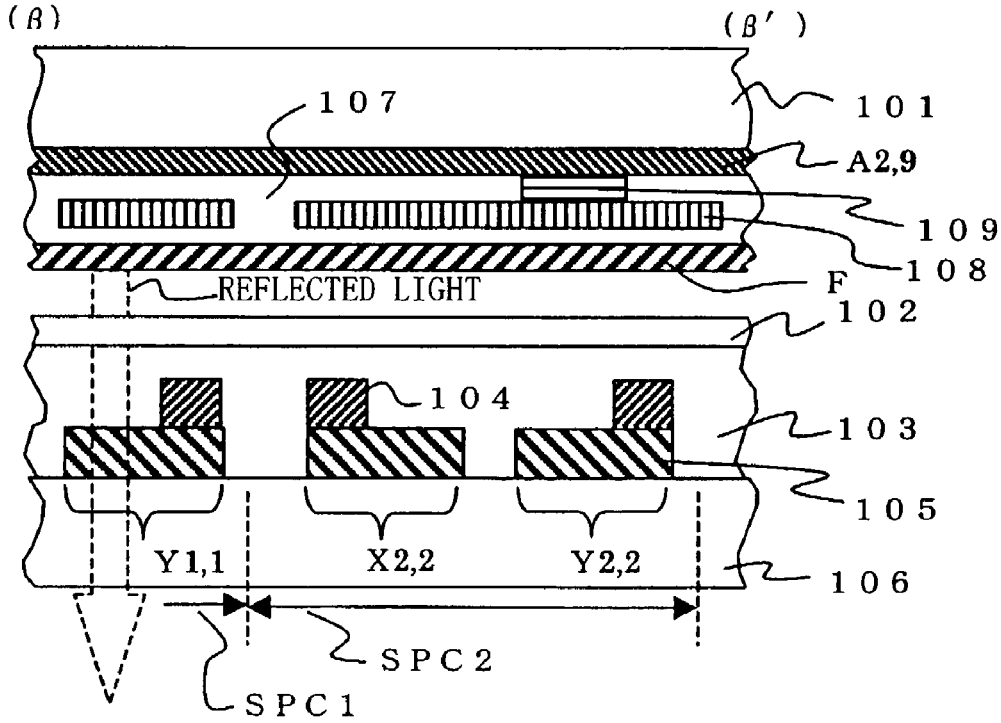
FIG. 3B is a cross-sectional view taken along line β–β' in FIG. 2.

As can be seen from the transverse cross sections of FIGS. 3A, 3B, in each sub-pixel region, the second conductive layer 108 covers the address electrodes. In the pixel C1,1, two address electrodes A1,1, A2,1 are provided for the sub pixel SPC1, and the second conductive layer 108 in the sub pixel SPC1 is connected to the address electrode A1,1 via a through hole. Similarly, in the pixel C1,1, two address electrodes A1,1, A2,1 are provided for the sub pixel SPC2, and the second conductive layer 108 in the sub pixel SPC2 is connected to the address electrode A2,1 via a through hole. A voltage required to address a specific sub pixel is supplied from the second conductive layer 108 provided in the specific sub pixel. The second conductive layer 108 also functions to shield the potential of the other electrode, that is, the electrode to which the second conductive layer 108 is not connected. The two sub pixels SPC1, SPC2 shown in the present embodiment have a uniform shape.

In the case where gray-scale display of each pixel is provided by controlling the number of sub pixels to be turned ON, three gray levels 0, 1, 2 are possible. As opposed to the conventional plasma display device, this plasma display device can address two lines simultaneously. Therefore, the address period per line is reduced by half. However, the number of scanning lines is doubled. As a result, the total address period is the same as the conventional PDP.

It is now assumed that each sustain cycle period is 8 μs, the number of sustain cycles per gray level is two cycles, each reset period is 50 μs, and each address cycle period is 3 μs. The sub frames produced by a time dither method have a length ratio of 1:2:4:8:16:32:64:128. Therefore, 384 gray levels can be displayed in a one-field period in the sub pixels SPC1, SPC2. Higher definition (up to 480 (pixels)×1.3 in the column direction) can be implemented while maintaining this 384 gray-level display.

The present embodiment does not use the means for implementing higher definition by dividing the display screen into upper and lower display screens as disclosed in Japanese Laid-Open Publication No. 11-133912, but uses a means for implementing higher definition by addressing a plurality of adjacent rows simultaneously. Therefore, written pixel information does not include a low-frequency error component, but is formed by a signal component and a high-frequency error component. This reduces non-uniformity of the gray-scale display to an acceptable level.

According to the above structure, the total address period is not increased. Rather, the total address period can be reduced, thereby facilitating implementation of a greater number of gray levels and improved definition.

As shown in FIGS. 2, 3A and 3B, this plasma display device is structurally characterized in that an island-shaped second conductive layer 108 is connected via a through hole to one of a plurality of address electrodes AJ,M provided in a sub pixel. This enables a plurality of sub pixels to be addressed simultaneously and independently.

In the present embodiment, each pixel may be formed by a plurality of sub pixels having different bright levels. Each pixel may be formed by three or more sub pixels.

Two sub pixels SPC1, SPC2 in the present embodiment have a uniform shape. Therefore, the sub pixels SPC1, SPC2 may alternatively be allocated to two independent pixels in order to implement higher definition.

Each address electrode may have a two-layer structure of a transparent electrode and an opaque electrode in order to reduce the resistance of the electrode.

Each address electrode may extend to the side surface of a corresponding partition wall. In this case, no through hole is formed, and a bridge-like conductor layer is formed instead. Accordingly, the address electrode can be connected to the second conductive layer 108 through the bridge-like conductor layer. In either case, in order to reduce crosstalk, it is necessary for the second conductive layer 108 to cover the end of the address electrode which faces the partition wall.

An insulator layer 107 is formed from an insulating material, and is preferably formed from a material having a low dielectric constant. However, the insulator layer 107 may be formed from the same fluorescent material as that of the sub pixels. Other structure and materials may be the same as those of the conventional example described in connection with FIG. 15.

Two-dotted chain line in FIG. 2 indicating the boundary between the sub pixels SPC1 and SPC2 is a phantom line, and therefore does not exist actually. However, in order to reduce or shield leakage of light (crosstalk) in the gap between the electrodes of adjacent sub pixels in the column direction, a not-shown light-shielding film may be provided on the outer or inner surface of the glass substrate 106 (FIGS. 3A, 3B).

The above structure may be combined with controlling the number of sub pixels of the X-electrode direction to be turned ON.

Second Embodiment

In the plasma display device of the second embodiment, each pixel is formed by a plurality of sub pixels of the same color provided in the X-electrode direction. This plasma display device provides gray-scale display by controlling the number of sub pixels to be turned ON. In this plasma display device, a plurality of address electrodes are provided for each sub pixel, and each sub pixel is addressed by a second conductive layer which is electrically connected to one of the plurality of address electrodes. The plasma display device of the second embodiment thus provides a solution to implement a greater number of gray levels and higher definition.

The structure of the second embodiment will now be described with reference to FIG. 4.

Figure 4:
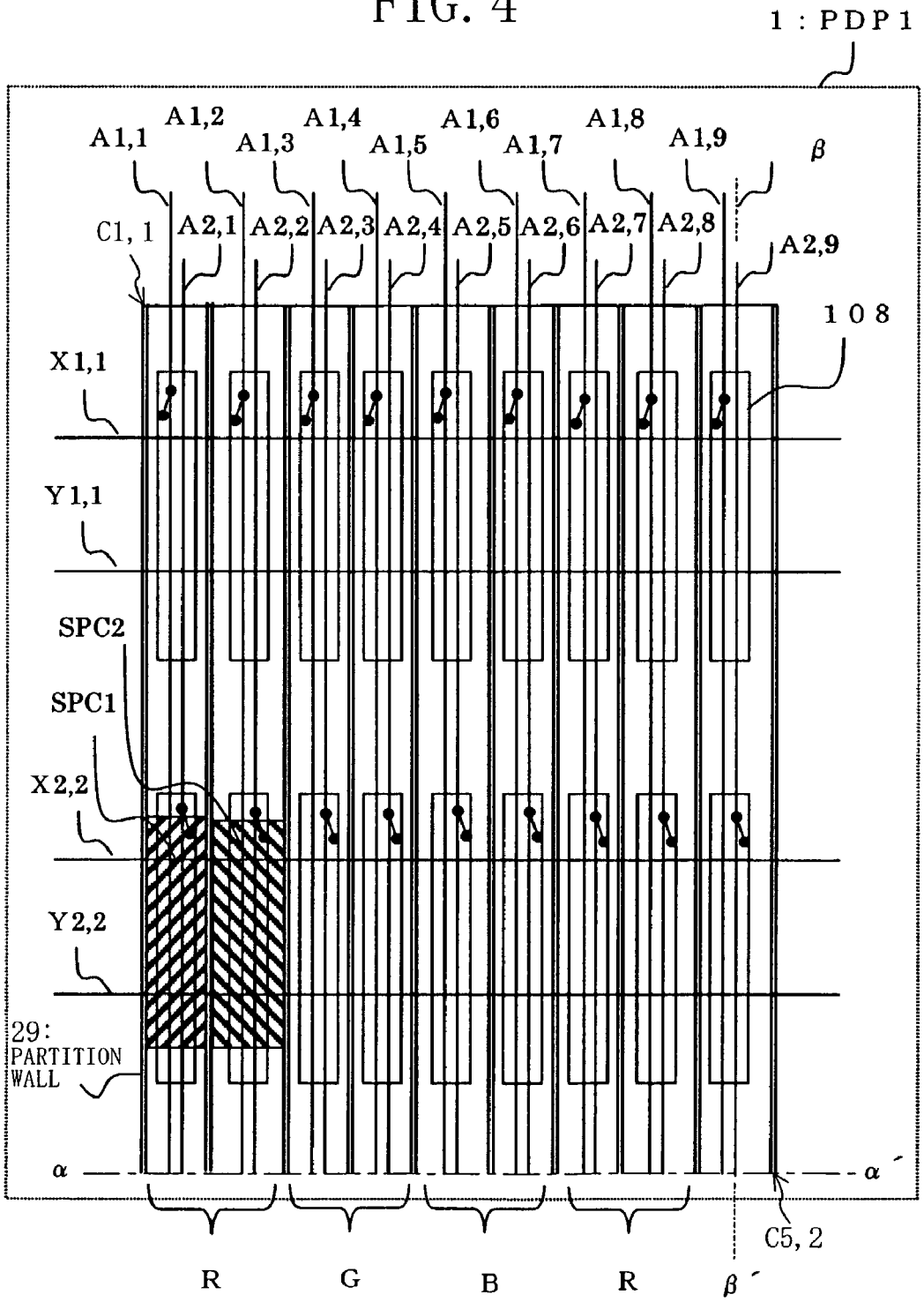
FIG. 4 is an enlarged partial schematic plan view of a PDP according to a second embodiment of the present invention.

FIG. 4 is an enlarged partial schematic plan view showing the region of pixels C1,1 to C5,2 in the PDP 1.

Each unit pixel CM,N of the PDP 1 is formed by two sub pixels provided in the X-electrode direction (where M is in the range of 1 to 1,280×3, and N is in the range of 1 to 1,024). Two address electrodes AJ,M, an X-electrode XK,N, and a Y-electrode YL,N are provided for each sub pixel (where J, K, L is 1 or 2).

In each sub-pixel region, a second conductive layer 108 covers the address electrodes. In the pixel C1,2, two address electrodes A1,1, A2,1 are provided for the sub pixel SPC1, and the second conductive layer 108 in the sub pixel SPC1 is connected to the address electrode A2,1 via a through hole. Similarly, in the pixel C1,2, two address electrodes A1,2, A2,2 are provided for the sub pixel SPC2, and the second conductive layer 108 in the sub pixel SPC2 is connected to the address electrode A2,2 via a through hole. A voltage required to address a specific sub pixel is supplied from the second conductive layer 108 provided in the specific sub pixel. The two sub pixels SPC1, SPC2 shown in the present embodiment have a uniform shape.

The above two types of sub pixels are provided also in the vertical direction by the means described in the first embodiment. In the present embodiment, however, the two types of sub pixels provided in the vertical direction form independent two pixels. Therefore, the number of scanning lines is 1,024, but the address time is equal to half the scanning time of 1,024 lines.

Hereinafter, a gray-scale display means of the PDP 1 of the second embodiment will be described. The example described below shows gray-scale display of the pixel C1,2. It is herein assumed that each sustain cycle period is 8 μs, the number of sustain cycles per gray level is 2, each reset period is 50 μs, and each address cycle period is 3 μs.

The two sub pixels SPC1, SPC2 of the pixel C1,2 provided in the row direction are allocated to two gray levels (the lowest gray level and the second lowest gray level). Regarding the pixel C1,2, the number of sub pixels to be turned ON is controlled to display three gray levels 0, 1, 2. The remaining upper seven bits are allocated to a gray-scale display means based on the time dither method, i.e., a means for dividing each field into a plurality of sub frames and turning ON a predetermined pixel during a period of a predetermined sub frame.

The sub frames produced by the time dither method have a length ratio of 1:2:4:8:16:32:64. In combination with the gray-scale display means for controlling the number of sub pixels SPC1, SPC2 to be turned ON, the PDP 1 can display 384 gray levels. For example, gray level 3 is displayed by addressing the sub pixels SPC1, SPC2 and generating sustain discharge in a period of the sub frame having a length ratio of 1.

The above structure of the present invention thus enables implementation of display of higher definition and a greater number of gray levels in the horizontal direction.

This plasma display device is structurally characterized in that an island-shaped second conductive layer is connected via a through hole to one of a plurality of address electrodes AJ,M provided in a sub pixel. This enables a plurality of sub pixels to be addressed simultaneously and independently.

A frame period required to display all pixels of a single field with 384 gray levels is 13.15 ms. Therefore, in addition to implementation of display of higher definition and a greater number of gray levels, the time can further be allocated for implementation of higher brightness. Accordingly, by changing the number of sustain cycles per gray level to five, higher brightness can be implemented while maintaining 384 gray levels.

Each pixel may be formed by three or more sub pixels provided in the row direction. This enables implementation of further improved display in terms of definition and the number of gray levels.

The two sub pixels SPC2, SPC1 may be allocated to the lowest gray level and the second lowest gray level, respectively.

One of the two sub pixels SPC2, SPC1 may be allocated to an upper bit of the gray-scale display means based on the time dither method.

Each pixel may be formed by three or more sub pixels provided in the address-electrode direction.

Figure 15:
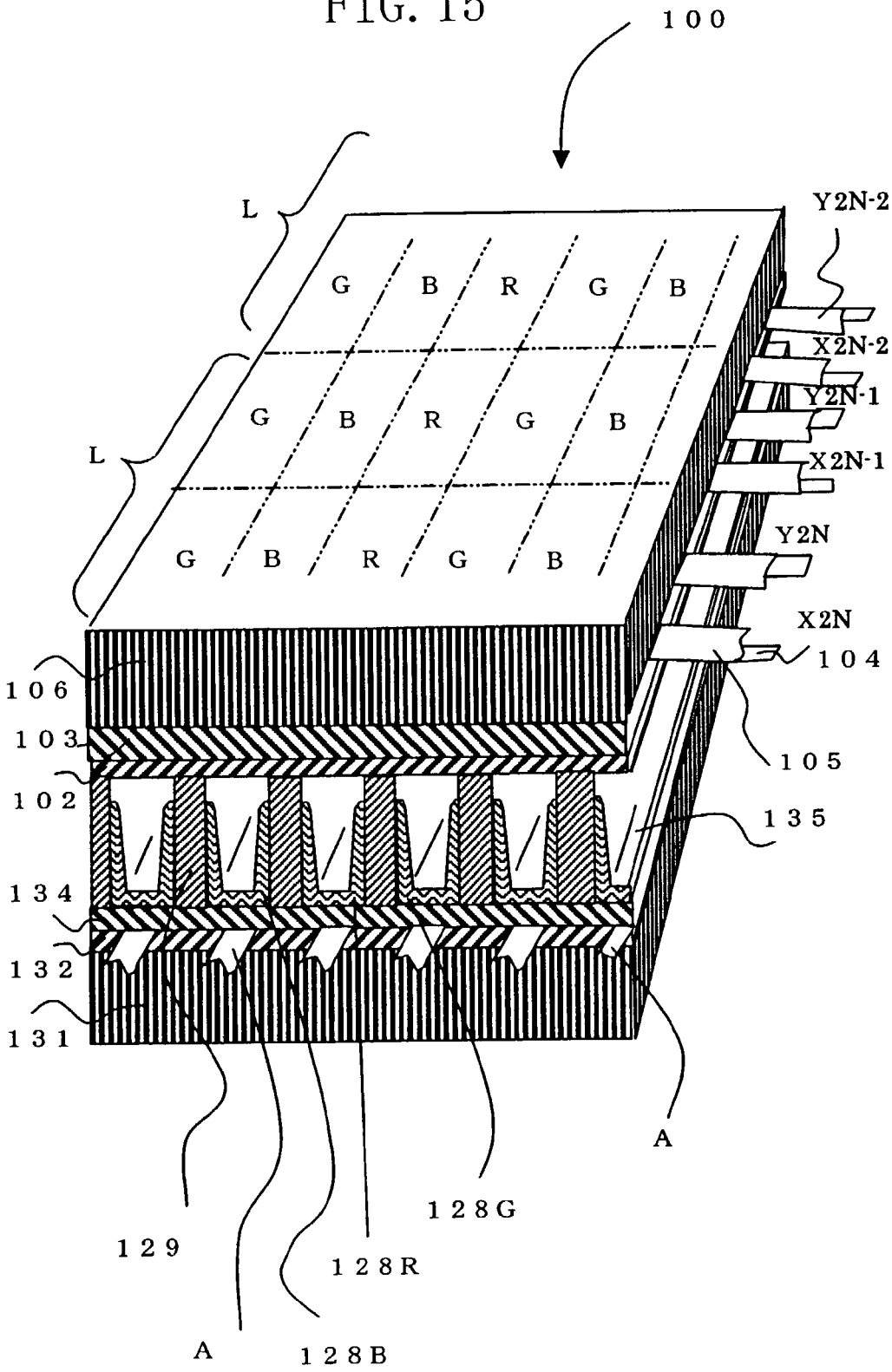
FIG. 15 is a perspective view showing the internal structure of a conventional PDP.
Figure 16:
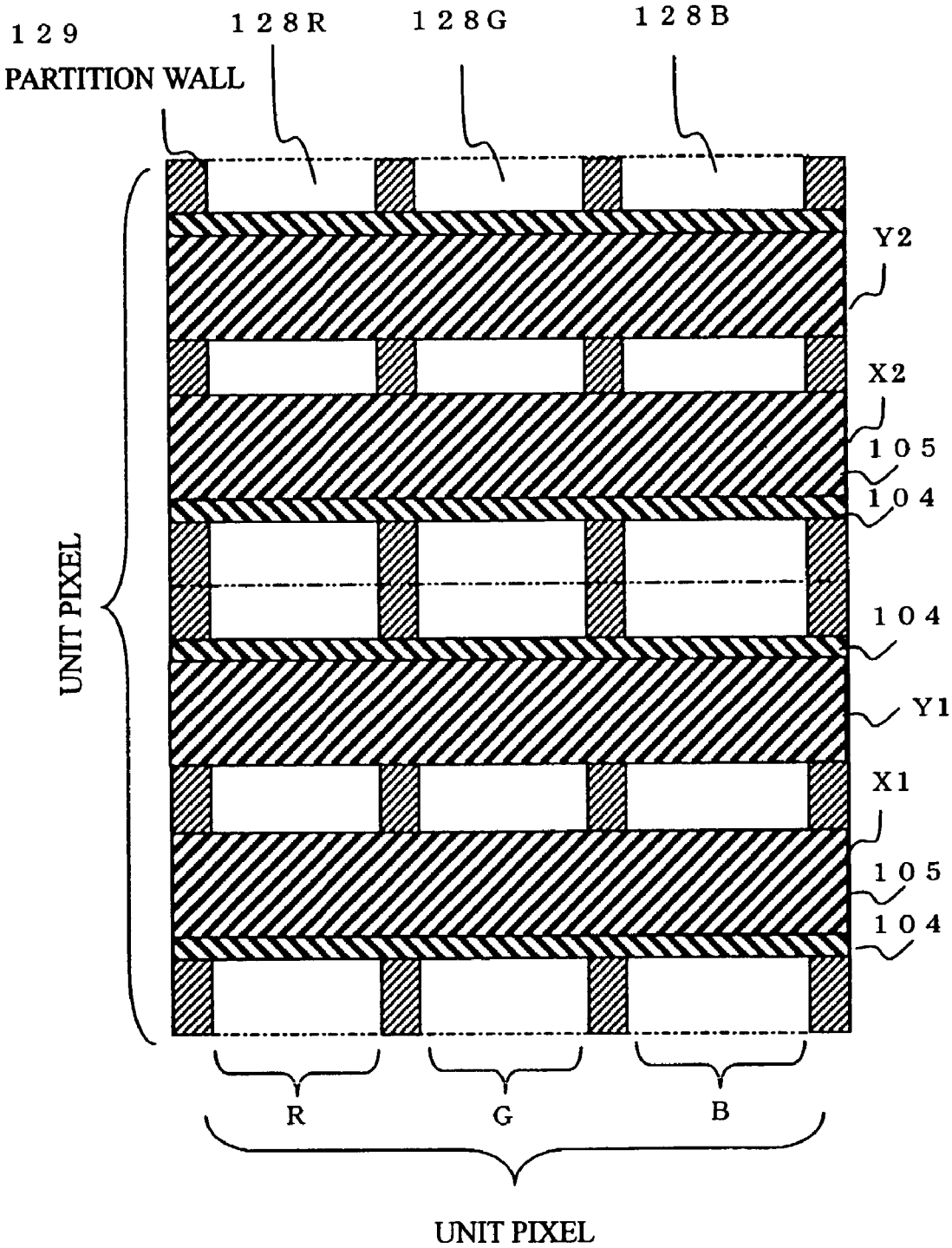
FIG. 16 specifically illustrates the structure of a conventional PDP.
Figure 17A:
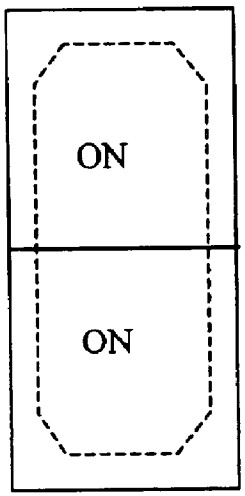
Figure 17B:
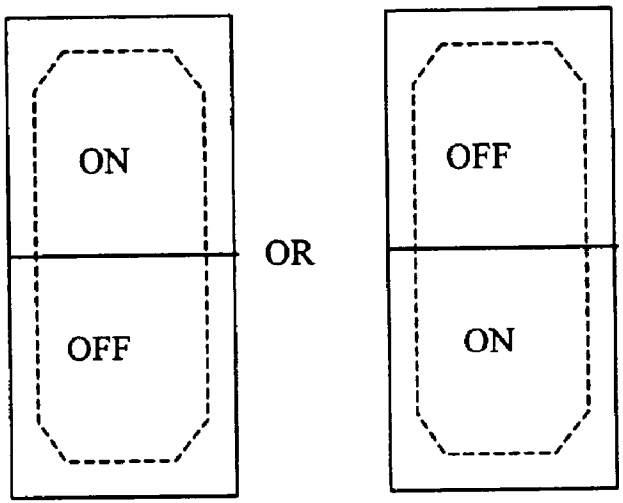
Figure 17C:
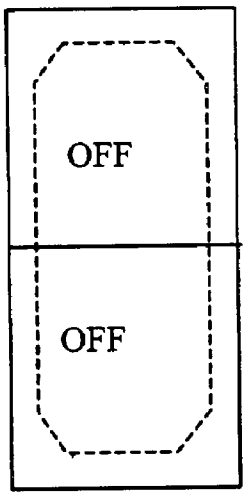

Each sub pixel of the present embodiment may have the same shape in transverse cross section as that of the conventional example in FIG. 15 except that there is a second conductive layer 108, that the fluorescent layers are arranged with a stripe pattern in order of R, R, G, G, B, B, and the like. Each sub pixel of the present embodiment may have the same shape in transverse cross section as that of FIGS. 3A, 3B except that a plurality of sub pixels of the same color are provided adjacent to each other.

Third Embodiment

The plasma display device of the third embodiment includes a plurality of sub pixels provided adjacent to each other. The plurality of sub pixels include two types of sub pixels having different electrode lengths in the direction in which the plurality of sub pixels are arranged. In other words, in the two types of sub pixels, an electrode extends with different lengths in the direction in which the plurality of sub pixels are arranged. The plasma display device of the third embodiment provides gray-scale display by controlling a combination of sub pixels to be turned ON, thereby providing a solution to implement a greater number of gray levels and higher definition.

The structure of the third embodiment will now be described with reference to FIG. 5.

Figure 5:
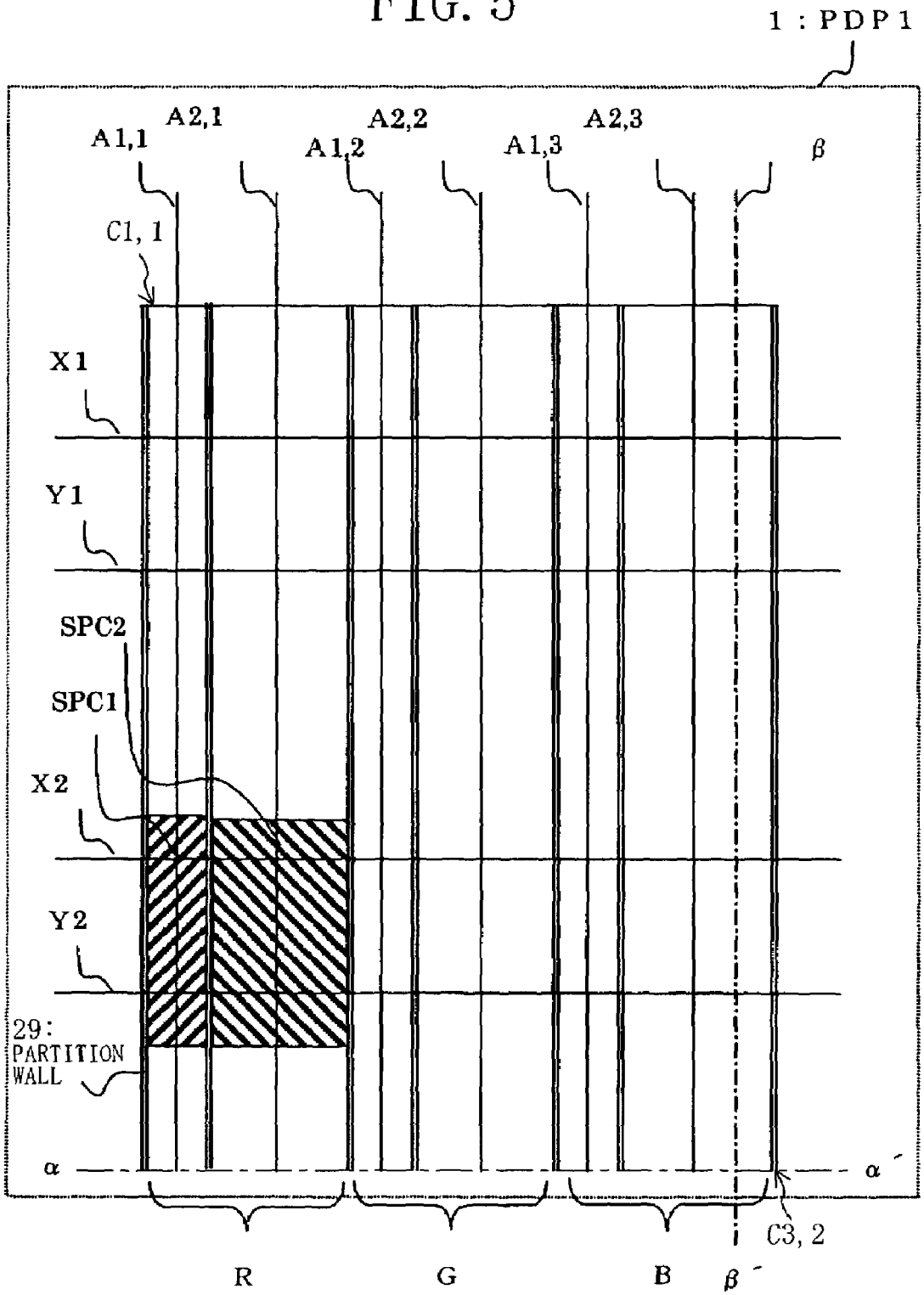
FIG. 5 is an enlarged partial schematic plan view of a PDP according to a third embodiment of the present invention.

FIG. 5 is an enlarged partial schematic plan view showing the region of pixels C1,1 to C3,2 in the PDP 1.

Each pixel CM,N of the PDP 1 is formed by two sub pixels provided in the row direction (where M is in the range of 1 to 680×3, and N is in the range of 1 to 480). An address electrode AJ,M, an X-electrode XN, and a Y-electrode YN are provided for each sub pixel (where J is 1 or 2).

Two sub pixels SPC1, SPC2 forming each unit pixel have a bright-level ratio of 1:2. This bright-level ratio is implemented by providing sub pixels having different widths between corresponding partition walls (i.e., gaps between partition walls), that is, sub pixels having different X-electrode lengths (i.e., an X-electrode corresponding to the sub pixels extends with different lengths in each of the sub pixels), and optimizing a discharge current of each sub pixel (gap between partition walls) and luminous efficiency of a fluorescent material (a region covered with a luminous material). The number of scanning lines is 480.

Hereinafter, a gray-scale display means of the PDP 1 of the third embodiment will be described. The example described below shows gray-scale display of the pixel C1,2. It is herein assumed that each sustain cycle period is 8 μs, the number of sustain cycles per gray level is 2, each reset period is 50 μs, and each address cycle period is 3 μs.

The two sub pixels SPC1, SPC2 of the pixel C1,2 provided in the row direction are allocated to two gray levels (the lowest gray level and the second lowest gray level). Since the sub pixels SPC1, SPC2 of the pixel C1,2 have two bright levels, controlling the number of sub pixels to be turned ON in a stepwise manner enables display of four gray levels 0, 1, 2, 3. The remaining upper seven bits are allocated to a gray-scale display means based on the time dither method, i.e., a means for dividing each field into a plurality of sub frames and turning ON a predetermined pixel during a period of a predetermined sub frame.

The sub frames produced by the time dither method have a length ratio of 1:2:4:8:16:32:64. In combination with the gray-scale display means for providing gray-scale display by controlling the number of sub pixels SPC1, SPC2 to be turned ON, the PDP 1 can display 512 gray levels. For example, gray level 4 is displayed by addressing the sub pixels SPC1, SPC2 and generating sustain discharge in a period of the sub frame having a length ratio of 1.

The period required to display all pixels of a single field with 512 gray levels is 13.36 ms. Therefore, up to (480×1.3) pixels can be formed in the column direction while maintaining the 512 gray-level display. As a result, higher definition and a greater number of gray levels can be implemented simultaneously.

With the above structure, higher definition and a greater number of gray levels can be easily implemented.

Moreover, a plurality of sub pixels have different bright levels according to their X-electrode lengths. Therefore, higher definition and a greater number of gray levels can be easily implemented with a smaller number of address electrodes and a smaller pixel size.

Note that both sub pixels SPC2, SPC1 may be allocated to upper bits than those of the gray-scale display means based on the time dither method.

Each pixel may be formed by three or more sub pixels (sub pixels having a bright-level ratio of 1:2:4), and eight gray levels may be displayed in each pixel by controlling the number of sub pixels to be turned ON.

The means for providing a difference in bright level to the sub pixels is implemented by providing a plurality of sub pixels having different X-electrode lengths. Therefore, the partition walls may be eliminated. This enables reduction in size of a unit pixel.

The above structure may be combined with controlling the number of sub pixels of the address-electrode direction to be turned ON.

Fourth Embodiment

The plasma display device of the fourth embodiment includes a plurality of sub pixels provided adjacent to each other. The plurality of sub pixels have the same electrode length in the direction in which the plurality of sub pixels are arranged. In other words, in each of the plurality of sub pixels, an electrode extends with the same length in the direction in which the plurality of sub pixels are arranged. The plasma display device of the fourth embodiment provides gray-scale display by controlling the number of sub pixels to be turned ON, thereby providing a solution to implement a greater number of gray levels and higher definition.

The structure of sub pixels having two gray levels will now be described with reference to FIG. 6.

Figure 6:
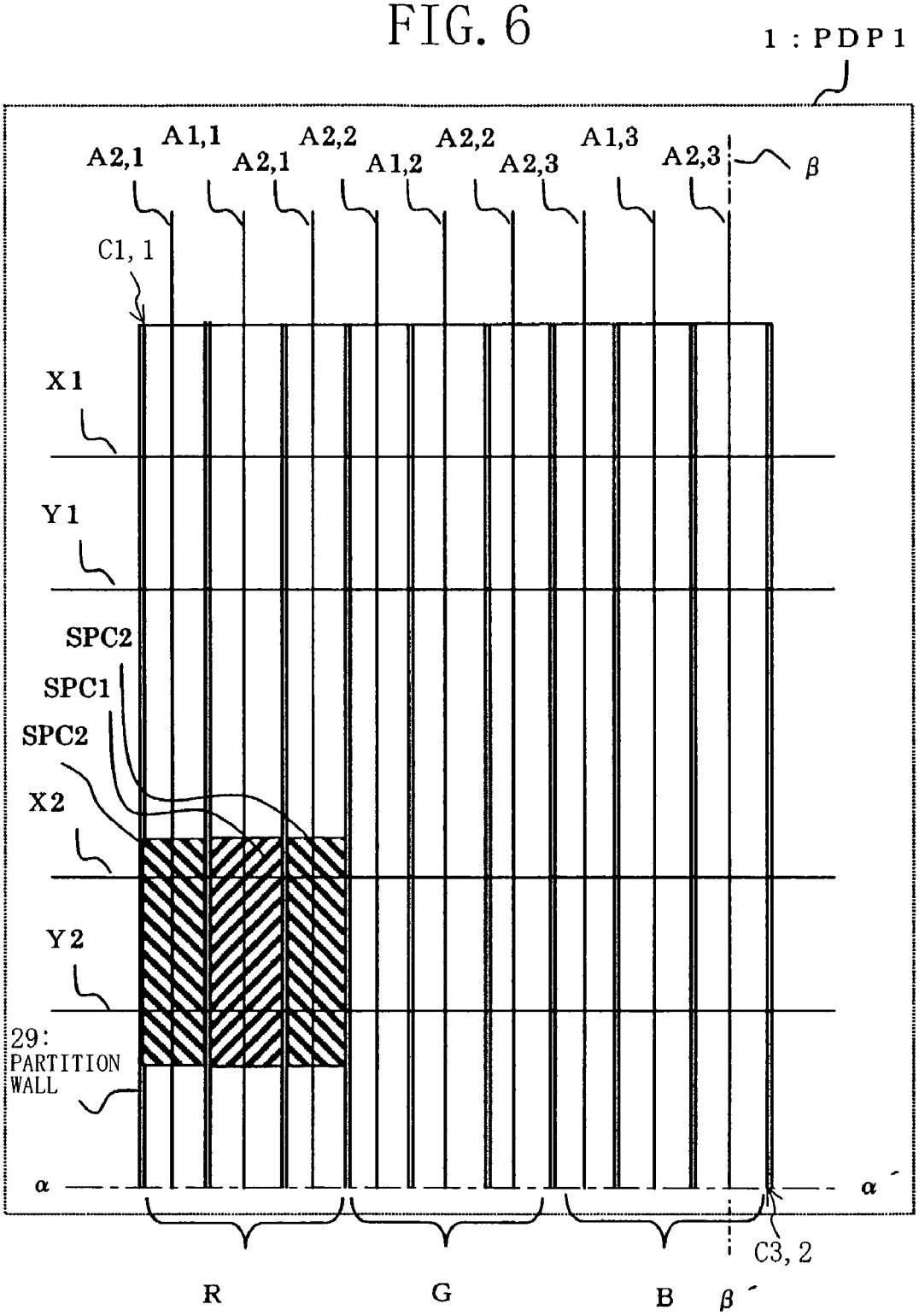
FIG. 6 is an enlarged partial schematic plan view of a PDP according to a fourth embodiment of the present invention.

FIG. 6 is an enlarged partial schematic plan view showing the region of pixels C1,1 to C3,2 in the PDP 1.

Each pixel CM,N of the PDP 1 is formed by three sub pixels of the same size provided in the row direction (where M is in the range of 1 to 680×3, and N is in the range of 1 to 480). Accordingly, the three sub pixels have the same X-electrode length in the row direction. In other words, an X-electrode extending in the row direction has the same length in each of the three sub pixels. An address electrode AJ,M, an X-electrode XN, and a Y-electrode YN are provided for each sub pixel (where J is 1 or 2).

A middle one of the three sub pixels is SPC1. The sub pixel SPC1 is interposed between sub pixels SPC2. A common address signal PAA is applied to both sub pixels SPC2. The two types of sub pixels SPC1, SPC2 forming a pixel thus have a bright-level ratio of 1:2.

Hereinafter, the structure of the fourth embodiment will be described.

As described in connection with FIG. 6, in the present embodiment, sub pixels having two bright levels are formed in the row direction. Two types of sub pixels may be provided also in the vertical direction by using the means described in the first embodiment. In this case, each pixel CM,N of the PDP 1 is formed by a total of six sub pixels (i.e., three sub pixels provided in the row direction and two types of sub pixels provided in the vertical direction), and the PDP 1 has M×N pixels (where M=680×3 and N=480). The number of scanning lines is 960. Such a PDP 1 will be described below.

Hereinafter, a gray-scale display means of the PDP 1 of the fourth embodiment will be described. It is herein assumed that each sustain cycle period is 8 μs, the number of sustain cycles per gray level is 2, each reset period is 50 μs, and each address cycle period is 3 μs.

The two types of sub pixels SPC1, SPC2 provided in the row direction are allocated to two gray levels (the lowest gray level and the second lowest gray level). Controlling the number of sub pixels of the row direction to be turned ON enables display of four gray levels. Moreover, controlling the number of sub pixels of the vertical direction to be turned ON enables display of three gray levels. The remaining upper seven bits are allocated to a gray-scale display means based on the time dither method, i.e., a means for dividing each field into a plurality of sub frames and turning ON a desired pixel during a period of a desired sub frame.

The sub frames produced by the time dither method have a length ratio of 1:2:4:8:16:32:64. In combination with the gray-scale display means for controlling the number of sub pixels SPC1, SPC2 to be turned ON, the PDP 1 can display 768 gray levels. For example, gray level 4 is displayed by addressing the sub pixels SPC1, SPC2 of the row corresponding to the X-electrode X1,N and the Y-electrode Y1,N and generating sustain discharge in a period of the sub frame having a length ratio of 1. Note that gray scale 1 is displayed when no sub pixel is addressed.

The period required to display all pixels of a single field with 768 gray levels is 13.36 ms.

With the above structure, a greater number of gray levels and higher definition can be easily implemented.

Note that the sub pixel SPC2 having a bright-level ratio of 2 may be formed by two adjacent sub pixels of the same row each having a bright-level ratio of 1.

Two electrodes A2,M (address electrodes in FIG. 6) may be driven by a common address driver.

A plurality of sub pixels provided in the column direction may have different bright levels.

Fifth Embodiment

In the plasma display device of the fifth embodiment, each picture element is formed by first and second pixels provided adjacent to each other in the X-electrode direction. Each of the first and second pixels is formed by sub pixels of R, G, B provided adjacent to each other in the X-electrode direction. According to a method for driving the plasma display device of the fifth embodiment, sub pixels of R, G, B are turned ON/OFF as follows: a gray-scale signal corresponding to the position of a first pixel of a picture element is applied to each of sub pixels of R, G, B in the first pixel of the picture element. Moreover, an average of a gray-scale signal which is applied to a corresponding one of the sub pixels of R, G, B in the first pixel of the picture element and a gray-scale signal which is applied to a corresponding one of sub pixels of R, G, B in a first pixel of an adjacent picture element (i.e., a picture element located adjacent to a second pixel of the above picture element) is applied to each of the sub pixels of R, G, B in the second pixel of the above picture element. In other words, a gray-scale signal corresponding to a first pixel of a picture element is applied to a plurality of sub pixels in the first pixel of the picture element, whereas a gray-scale signal of a function of the gray-scale signal corresponding to the first pixel of the picture element and a gray-scale signal corresponding to a first pixel of an adjacent picture element (i.e., a picture element located adjacent to a second pixel of the above picture element) is applied to a plurality of sub pixels in the second pixel of the above picture element. The driving method of the fifth embodiment thus easily provides a solution to implement a greater number of gray levels and higher definition.

The structure of the fifth embodiment will be described with reference to FIG. 7.

Figure 7:
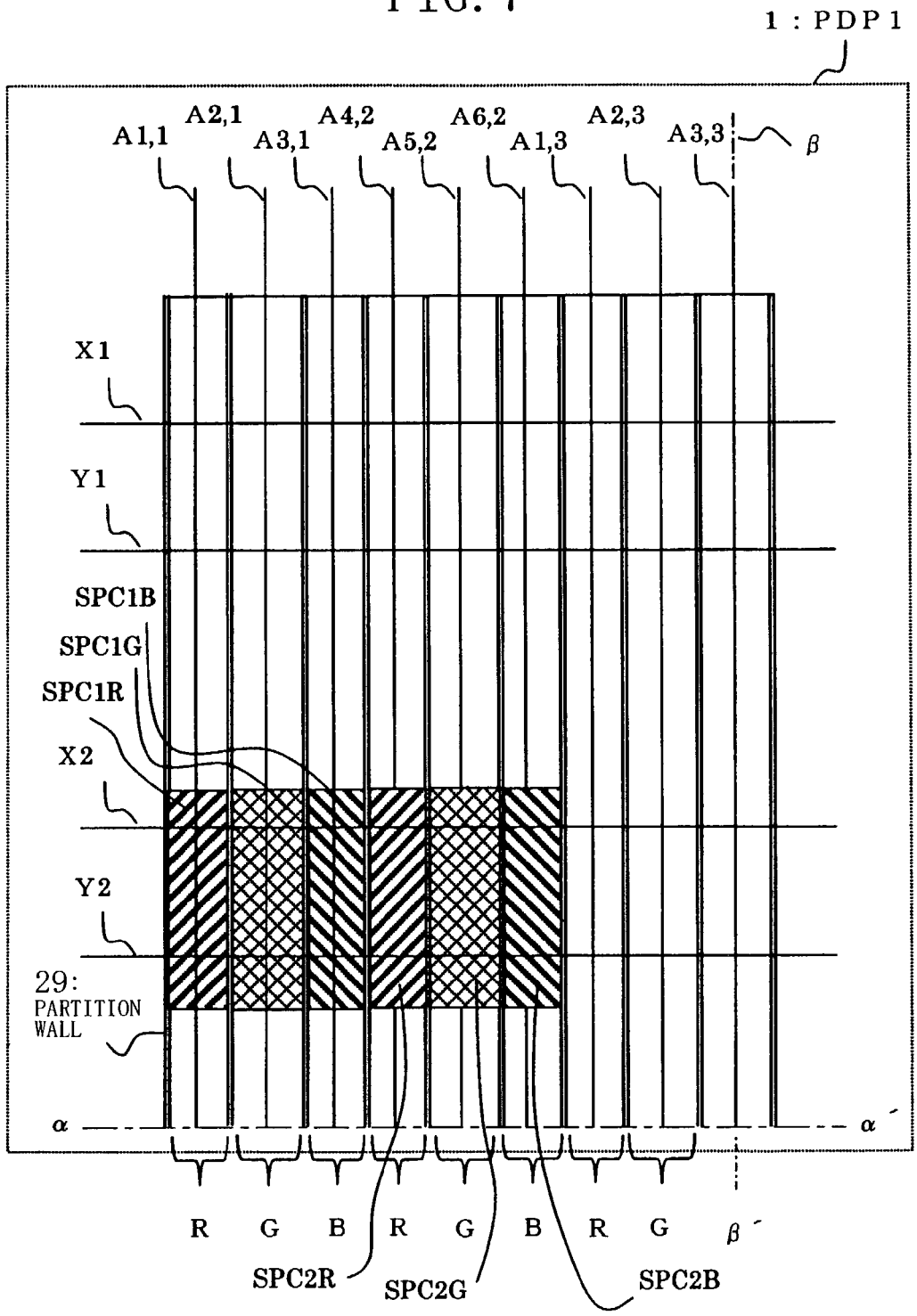
FIG. 7 is an enlarged partial schematic plan view showing the structure of sub pixels in a PDP according to a fifth embodiment of the present invention.

FIG. 7 is an enlarged partial schematic plan view showing the region of picture elements C1,1, C1,2 and half the region of picture elements C2,1, C2,2 in the PDP 1.

Each picture element CM,N of the PDP 1 is formed by first and second pixels provided in the row direction. Each pixel is formed by three sub pixels of R, G, B. The PDP 1 has M picture elements in the row direction and N picture elements in the column direction. Independent address electrodes AJ,M, an X-electrode XN and a Y-electrode YN are provided for six sub pixels of each picture element (where J is in the range of 1 to 6). The X-electrode XN and the Y-electrode YN are each connected to a common potential. Sub pixels SPC1R, SPC1G, SPC1B, SPC2R, SPC2G, SPC2B have a uniform size.

Hereinafter, the driving method of the present embodiment which implements a greater number of gray levels will be described.

Display data D(1,2)R, D(1,2)G, D(1,2)B are respectively written to the sub pixels SPC1R, SPC1G, SPC1B of the first pixel in the picture element C1,2. Display data D(2,2)R, D(2,2)G, D(2,2)B are respectively written to sub pixels of the first pixel in the picture element C2,2.

Display data {D(1,2)R+D(2,2)R}/2, {D(1,2)G+D(2,2)G}/2, {D(1,2)B+D(2,2)B}/2 are respectively written to the sub pixels SPC2R, SPC2G, SPC2B of the second pixel in the picture element C1,2.

By a gray-scale display means formed by 7-bit sub frames based on the time dither method, the display data D(1,2)R, D(1,2)G, D(1,2)B, {D(1,2)R+D(2,2)R}/2, {D(1,2)G+D(2,2)G}/2, {D(1,2)B+D(2,2)B}/2, D(2,2)R, D(2,2)G, D(2,2)B are respectively written to corresponding sub pixels of the PDP 1 through corresponding address electrodes, X-electrode and Y-electrode.

In the present embodiment, a write signal to each sub pixel and display data corresponding to a pixel are correlated with each other as follows: display data (gray-scale signal) corresponding to a first pixel of a picture element is applied to the first pixel of the picture element as a write signal. Moreover, display data of a function of the display data (gray-scale signal) corresponding to the first pixel of the picture element and display data (gray-scale signal) corresponding to a first pixel of an adjacent picture element, i.e., a picture element located adjacent to a second pixel of the above picture element (a function according to a prescribed rule) is applied to the second pixel of the above picture element as a write signal. In this way, a greater number of gray levels and higher definition can be easily implemented.

Hereinafter, the terms used to describe the plasma display device of the fifth embodiment will be described.

A video signal is a signal based on a prescribed standard such as a TV standard. The video signal may match the display data, or may have a smaller amount of information (data) than the display data.

Display data refers to data stored in the frame memory 20 of the display data control section 11, as described in "Device structure" of the present invention.

A gray-scale signal is a signal resulting from a process for increasing the number of gray levels according to the present embodiment. The gray-scale signal collectively refers to data stored in the frame memory 22, a control signal SA based on sub-frame data, and a signal for actually driving a sub pixel.

Note that each pixel is formed by the number of sub pixels equal to a multiple of 3 or 6. Each pixel may have any structure as long as a fluorescent material is provided with stripe patterns of R, G, B.

Sixth Embodiment

In the plasma display device of the sixth embodiment, each pixel is formed by a plurality of sub pixels provided in the address-electrode direction. This plasma display device provides gray-scale display by controlling the number of sub pixels to be turned ON. This plasma display device includes two types of sub pixels having different electrode structures (i.e., a sub pixel having a single X-electrode and a single Y-electrode, and a sub pixel having two X-electrodes and two Y-electrodes) in order to provide the difference in bright level. A greater number of gray levels can thus be easily implemented.

The structure of the sixth embodiment will now be described with reference to FIG. 8.

Figure 8:
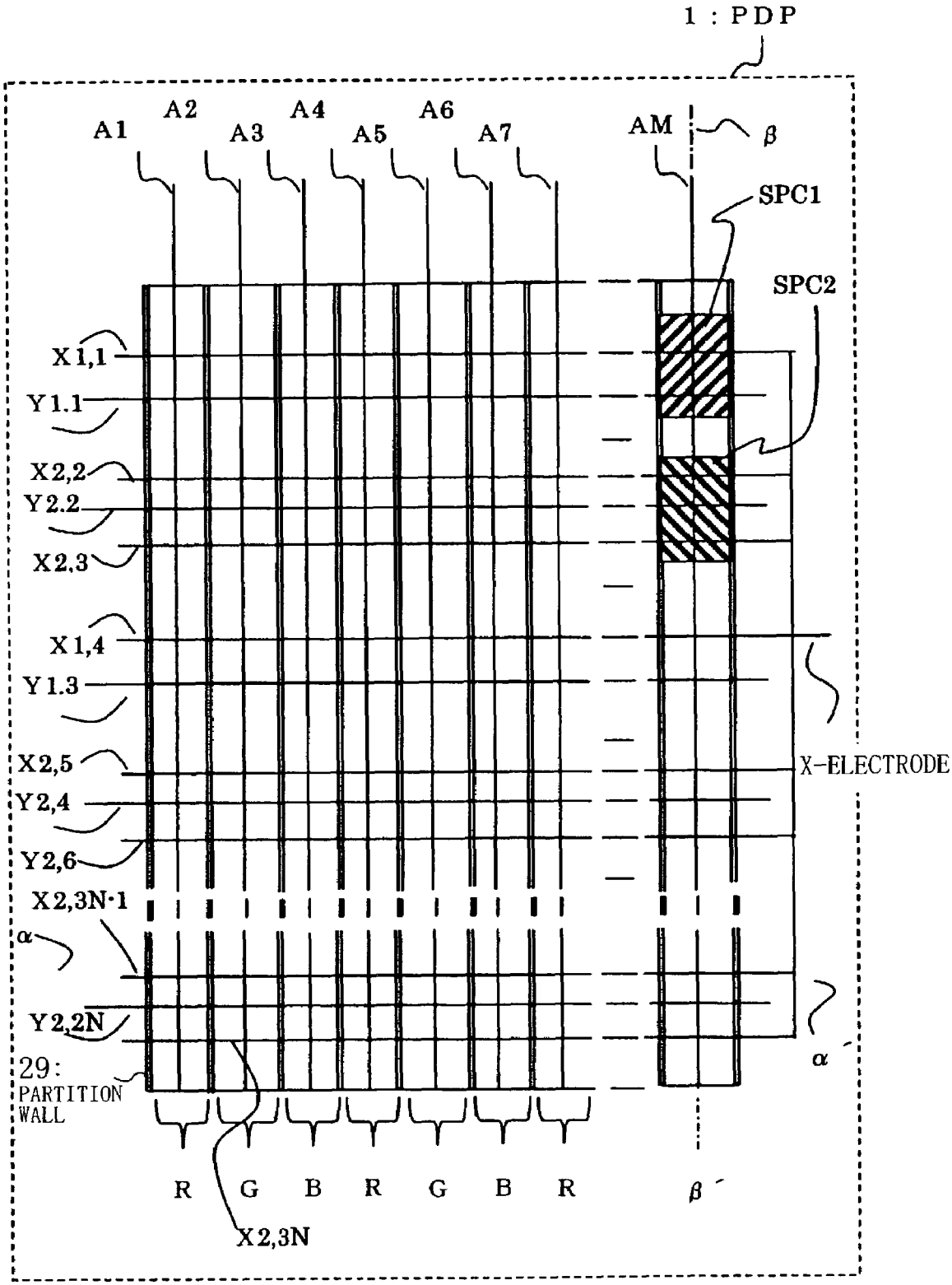
FIG. 8 is an enlarged partial schematic plan view of a PDP according to a sixth embodiment of the present invention.
Figure 9:
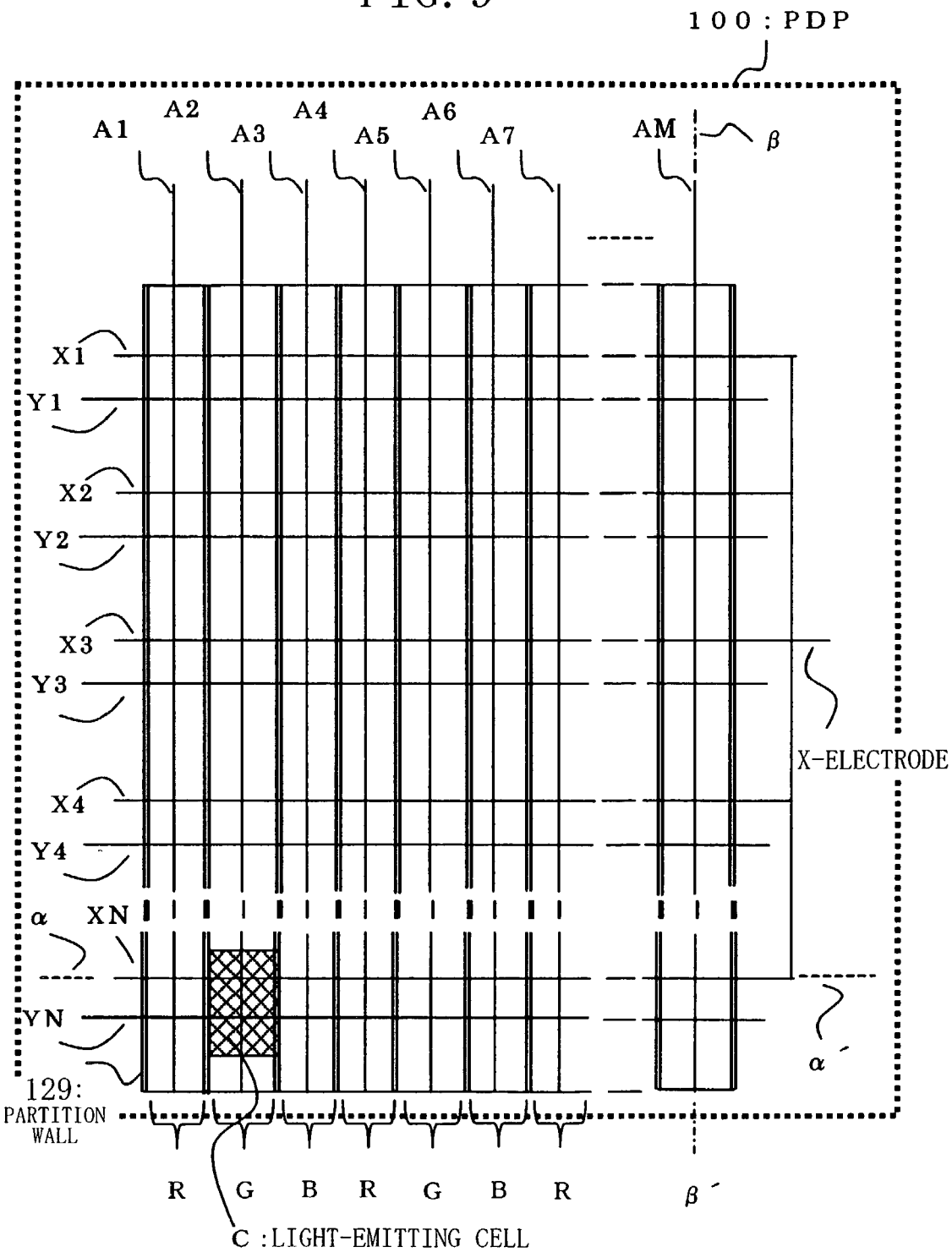
FIG. 9 is a plan view of a conventional PDP.
Figure 10A:
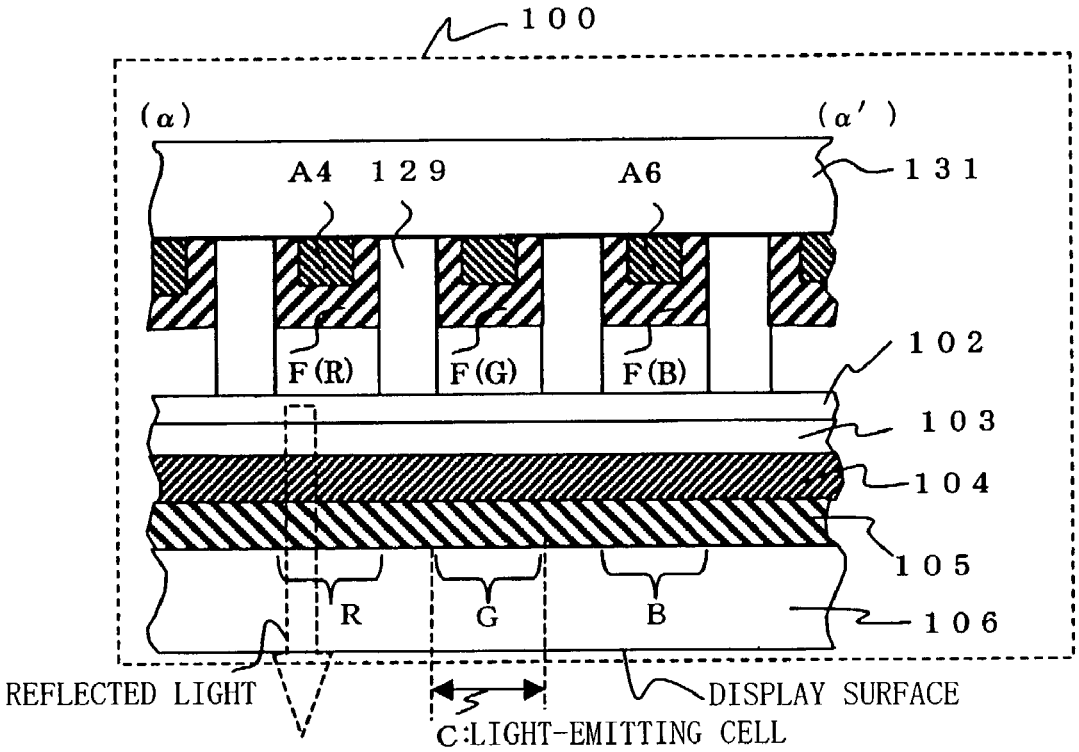
FIG. 10A is a cross-sectional view taken along line α–α' in FIG. 9.
Figure 10B:
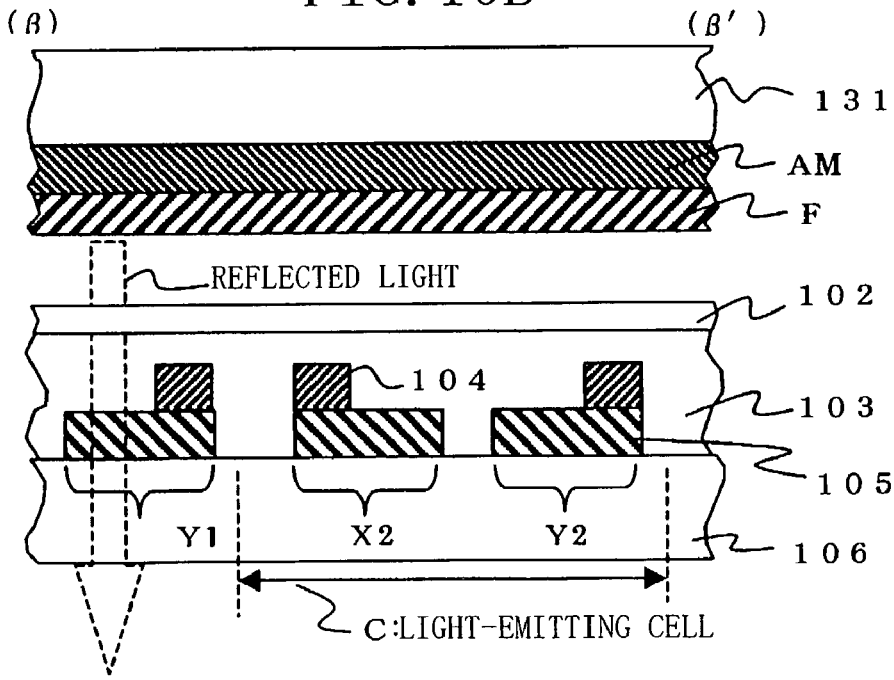
FIG. 10B is a cross-sectional view taken along line β–β' in FIG. 9.
Figure 11:
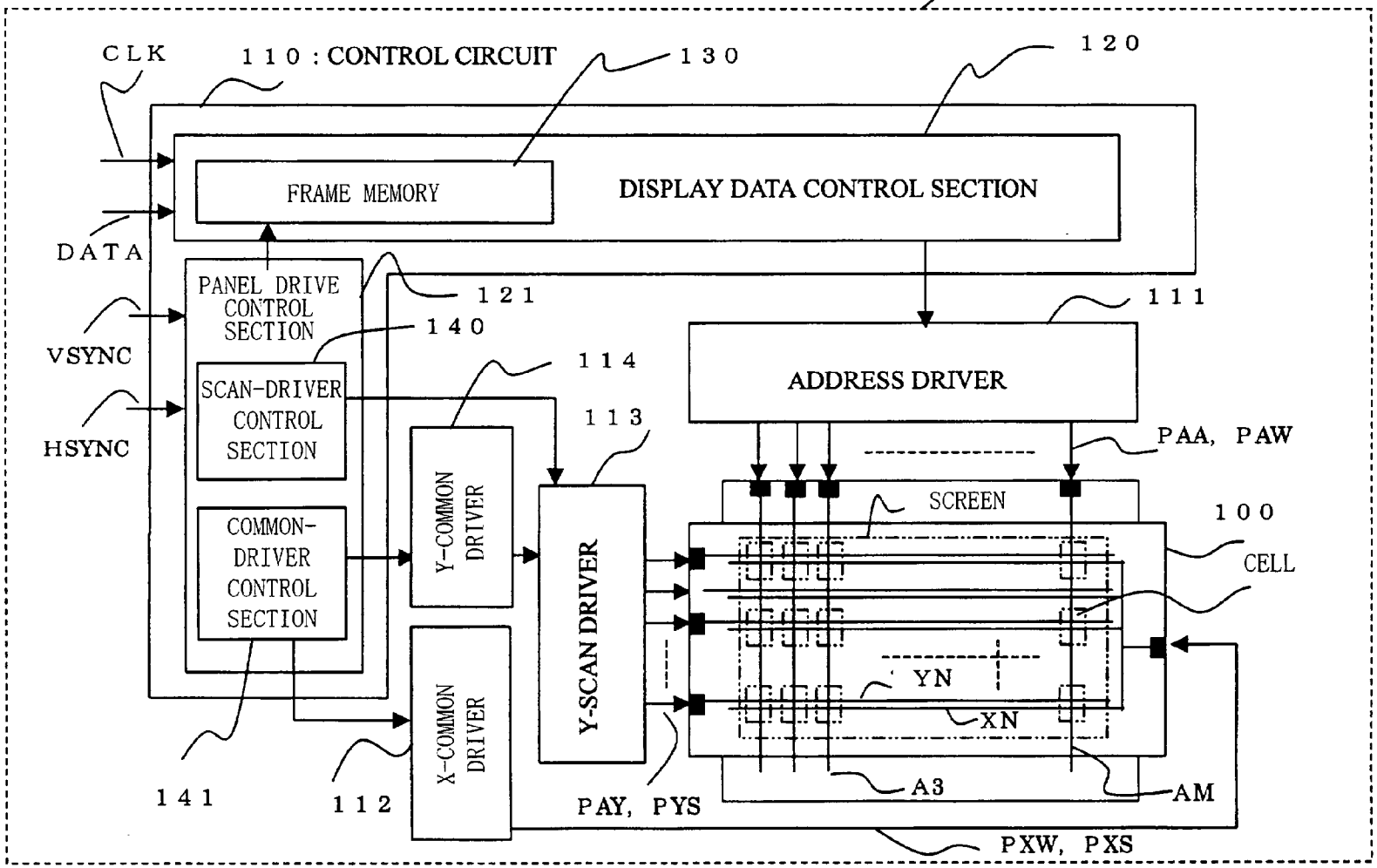
FIG. 11 is a schematic block diagram showing the structure of a conventional plasma display device.
Figure 12:
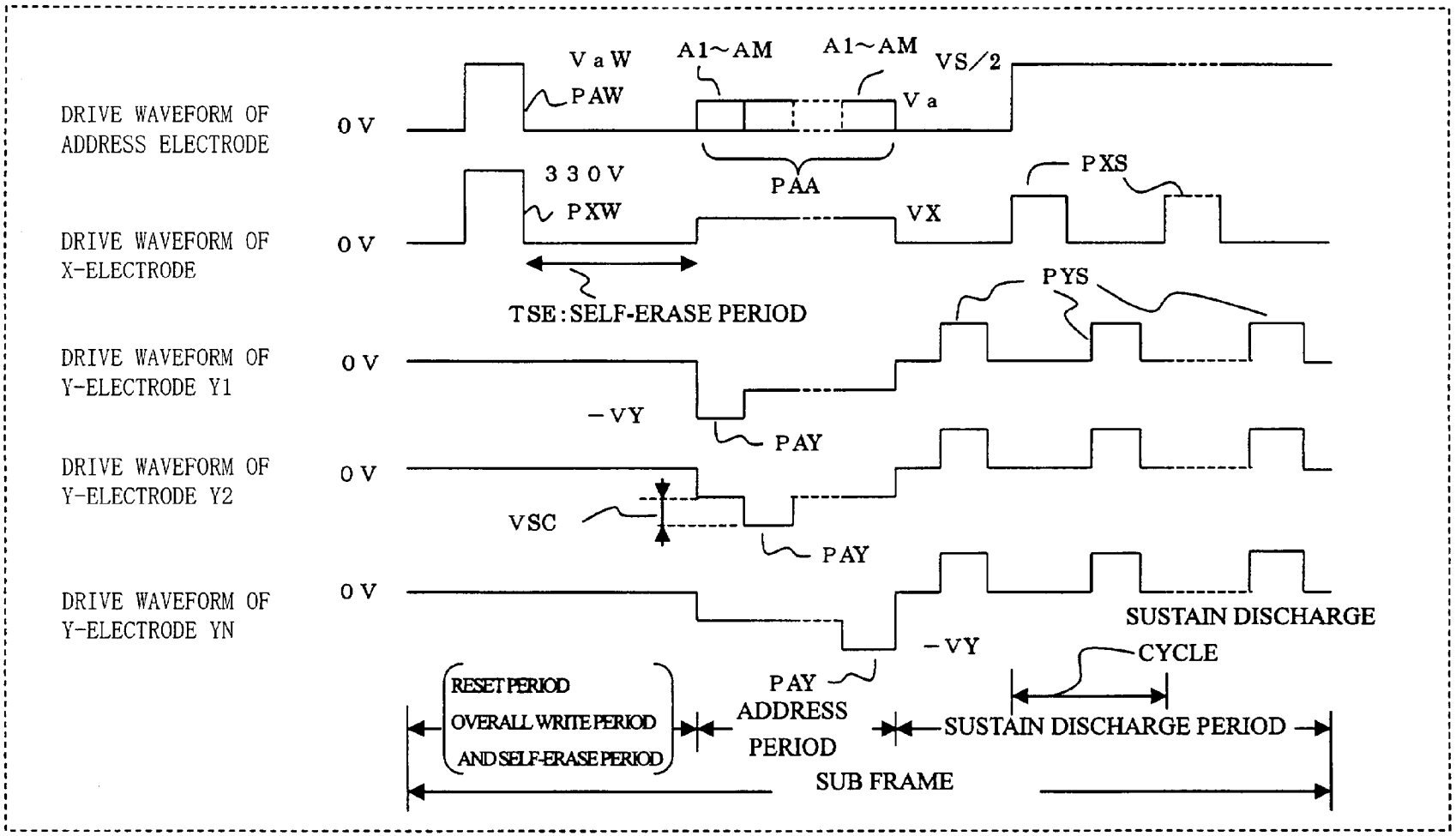
FIG. 12 is a timing chart illustrating operation of a conventional plasma display device.
Figure 13:
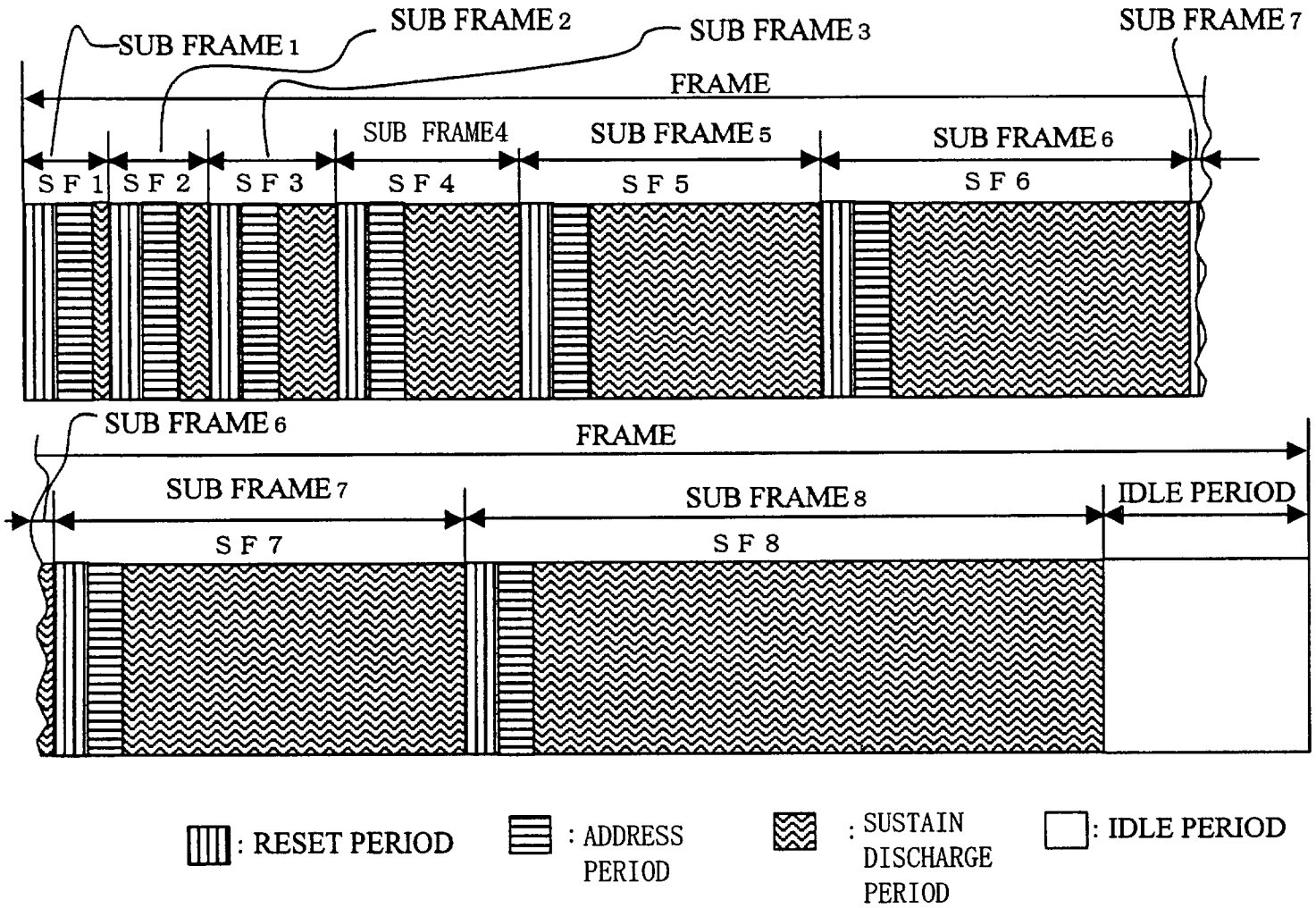
FIG. 13 shows the frame structure of conventional display data.
Figure 14:
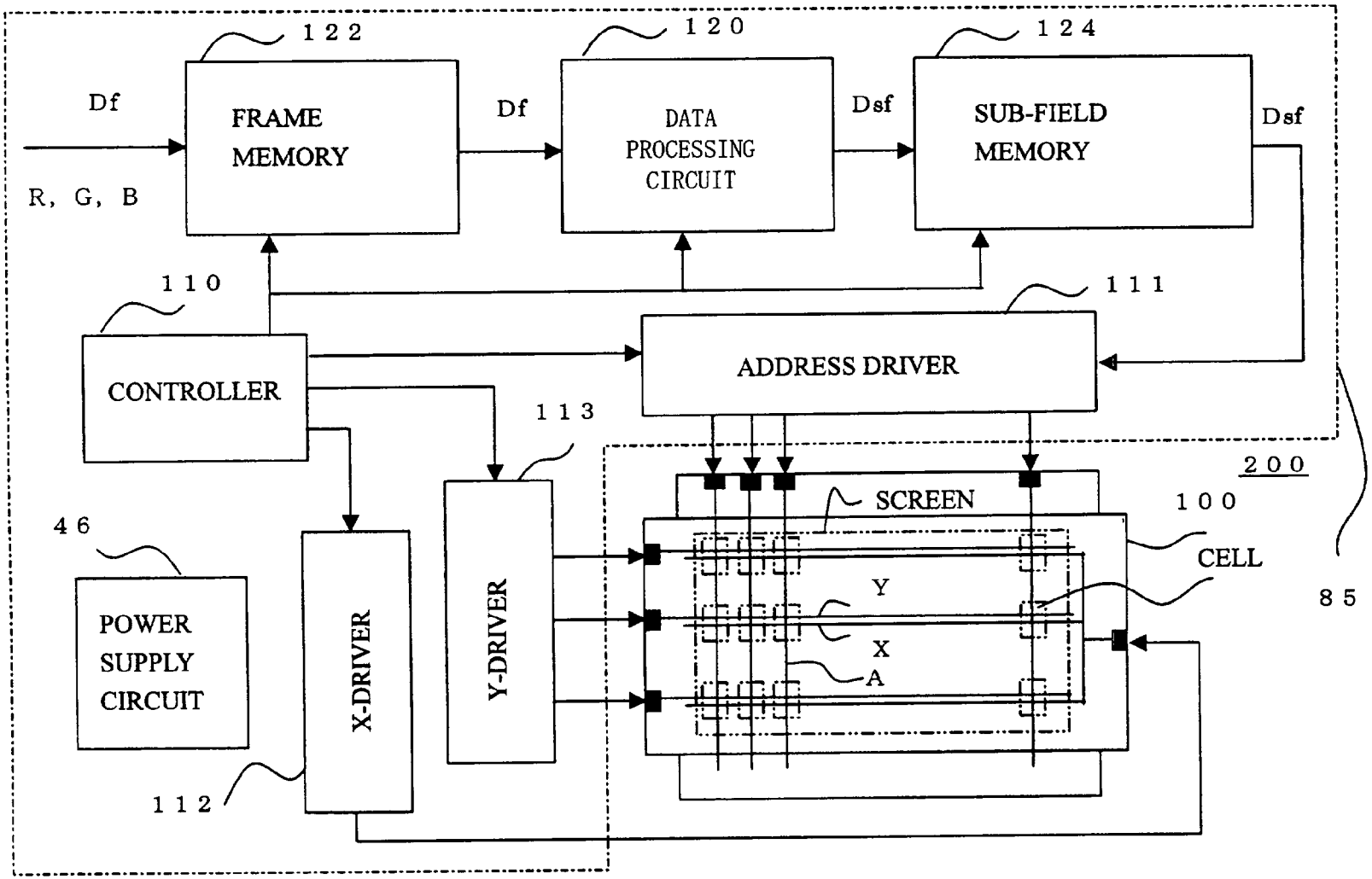
FIG. 14 shows the structure of a conventional plasma display device.

FIG. 8 is an enlarged schematic plan view of the PDP 1.

Each unit pixel CM,N of the PDP 1 is formed by two sub pixels SPC1, SPC2 provided in the column direction. The PDP 1 has M pixels in the row direction and N pixels in the column direction. A common address electrode AM extending in the column direction is provided for the sub pixels SPC1, SPC2.

X-electrodes and Y-electrodes are provided as follows: an X-electrode Xk,3N-2 (k-=1) and a Y-electrode Yk,2N-1 (k=1) extending in the row direction are provided for the sub pixel SPC1, and an X-electrode Xk,3N-1 (k=2), a Y-electrode Yk,2N (k=2) and an X-electrode Xk,3N (k=2) extending in the row direction are provided for the sub pixel SPC2. The X-electrodes Xk,3N-1 (k=2) and Xk,3N (k=2) are connected at a common potential to the X-common driver 4 in FIG. 1 in the same manner as that described above. Accordingly, two scanning lines are required for each pixel (one for SPC1 and one for SPC2). In the present embodiment, the Y-electrode of the sub pixel SPC2 is interposed between two X-electrodes, and the total discharge electrode length of the sub pixel SPC2 is twice that of the sub pixel SPC1. The sub pixels SPC1, SPC2 thus have a bright-level ratio of 1:2 so that the X-electrode length of the sub pixel SPC2 is twice that of the sub pixel SPC1 and the discharge current of the sub pixel SPC2 is twice that of the sub pixel SPC1. Accordingly, controlling the number of sub pixels SPC1, SPC2 to be turned ON enables display of four gray levels in each pixel.

In the conventional example, three scanning lines are required to implement four gray levels by using the sub pixels provided in the column direction. Therefore, a greater number of gray levels was not implemented.

In the above structure, however, four gray levels can be implemented by using the sub pixels corresponding to two scanning lines. In this way, by using a plurality of sub pixels having different bright levels in the column direction, the sub pixels can be provided in the column direction with a reduced number of scanning lines.

The present embodiment uses a means for implementing a greater number of gray levels by providing a plurality of sub pixels having different bright levels in the column direction. Even in the present embodiment, the number of scanning lines is greater than in the case where the gray-scale display means for controlling the number of sub pixels of the column direction to be turned ON is not used. Accordingly, it is desirable to use in the sixth embodiment the means for implementing a greater number of gray levels and higher definition described in the first to fifth embodiments.

The above structure may be combined with controlling the number of sub pixels of the X-electrode direction to be turned ON.

In the above embodiments, the present invention is described based on a progressive scanning method. However, it should be understood that the present invention is also applicable to an interlace scanning method.

While the present invention has been described in a preferred embodiment, it will be apparent to those skilled in the art that the disclosed invention may be modified in numerous ways and may assume many embodiments other than that specifically set out and described above. Accordingly, it is intended by the appended claims to cover all modifications of the invention that fall within the true spirit and scope of the invention.

What is claimed is:

1. A plasma display device comprising:

pixels each formed by a plurality of sub pixels provided in an address-electrode direction, for providing gray-scale display by controlling the number of sub pixels to be turned ON, wherein a difference in bright level is provided by two types of sub pixels having different electrode structures, in particular a sub pixel having a single X-electrode and a single Y-electrode and a sub pixel having two X-electrodes and a single Y-electrode.

2. The plasma display device according to claim 1, wherein the gray-scale display provided by controlling the number of sub pixels to be turned ON is provided by controlling the number of sub pixels of an X-electrode direction to be turned ON and the number of sub pixels of the address-electrode direction to be turned ON.

3. The plasma display device according to claim 1, wherein gray-scale display is performed according to input data in combination with the gray-scale display provided by controlling the number of sub pixels to be turned ON in each pixel formed by a plurality of sub pixels and gray-scale display based on a time dither method in which each filed is divided into a plurality of sub frames and each sub pixel is controlled to be or not to be turned ON in each sub frame.

4. A method for driving a plasma display device, wherein the plasma display device comprises picture elements each formed by first and second pixels provided adjacent to each other in an X-electrode direction, each of the first and second pixels is formed by sub pixels of R, G, B provided adjacent to each other in the X-electrode direction, the method comprising:

turning sub pixels of R, G, B ON/OFF by applying a gray-scale signal corresponding to a position of a first pixel of a picture element to each of sub pixels of R, G, B in the first pixel of the picture element, and applying to each of sub pixels of R, G, B in a second pixel of the picture element an average of a gray-scale signal which is applied to a corresponding one of the sub pixels of R, G, B in the first pixel of the picture element and a gray-scale signal which is applied to a corresponding one of sub pixels of R, G, B in a first pixel of an adjacent picture element, in particular a picture element located adjacent to the second pixel.

5. The method for driving a plasma display device according to claim 4, wherein gray-scale display is performed according to input data of the gray-scale display based on a time dither method in which each field is divided into a plurality of sub frames and each sub pixel is controlled to be or not to be turned ON in each sub frame.

6. A plasma display device comprising a plurality of pixels provided to align in the row and column directions, wherein each of the plurality of pixels has a plurality of sub pixels of the same color provided in the column direction, and a plurality of address electrodes extending in parallel to each other and along the plurality of sub pixels in the column direction, each of the plurality of sub pixels has a conductive layer electrically connected to any one of the plurality of address electrodes, a Y-electrode generating address discharge with the conductive layer, and an X-electrode generating sustain discharge with the Y-electrode, the plurality of sub pixels include at least two types of sub pixels addressed by a different address electrode of the plurality of address electrodes one another, gray-scale display is provided by controlling the number of sub pixels to be turned ON in each pixel;

wherein the plurality of address electrodes are a pair of address electrodes, each of the plurality of sub pixels is sandwiched between a pair of partition walls extending in the column direction, one address electrode of the pair of address electrodes extends to the side surface of one partition wall and the other address electrode extends to the side surface of the other partition wall, and the conductive layer is formed in a bridge-like shape to bridge the pair of partition walls and is electrically connected to an end of either one of the pair of extending address electrodes.

* * * * *